US007748699B2

(12) United States Patent
Nakashima

(10) Patent No.: US 7,748,699 B2
(45) Date of Patent: Jul. 6, 2010

(54) RETURN LEVER MEMBER, FEED DEVICE, RECORDING APPARATUS, AND LIQUID EJECTING APPARATUS

(75) Inventor: Hiroki Nakashima, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 273 days.

(21) Appl. No.: 11/766,546

(22) Filed: Jun. 21, 2007

(65) Prior Publication Data

US 2008/0002010 A1 Jan. 3, 2008

(30) Foreign Application Priority Data

Jun. 21, 2006 (JP) ..... 2006-171988

(51) Int. Cl.
*B65H 3/52* (2006.01)

(52) U.S. Cl. ..... 271/122; 271/121; 271/167

(58) Field of Classification Search ..... 271/121, 271/122, 167
See application file for complete search history.

(56) References Cited

U.S. PATENT DOCUMENTS

2002/0175462 A1* 11/2002 Sonoda et al. ..... 271/121
2008/0217839 A1* 9/2008 Bingham et al. ..... 271/121

FOREIGN PATENT DOCUMENTS

| | | | |
|---|---|---|---|
| JP | 10181904 A | * | 7/1998 |
| JP | 2000-118761 | | 4/2000 |
| JP | 2000-289873 | | 10/2000 |
| JP | 2004-010225 | | 1/2004 |
| JP | 2005-200141 | | 7/2005 |
| JP | 2005200141 A | * | 7/2005 |

* cited by examiner

*Primary Examiner*—Patrick Mackey
*Assistant Examiner*—Gerald W McClain
(74) *Attorney, Agent, or Firm*—Workman Nydegger

(57) ABSTRACT

A feed device includes a feed roller and a return lever member. The feed roller picks up a first recording medium from recording media stacked on a stacking unit and feeds the first recording medium downstream via a feed path. The return lever member pushes back upstream a second recording medium that has unnecessarily entered the feed path in feeding the first recording medium downstream. The stacking unit includes an end support portion that supports a leading end of the recording media from below. The return lever member includes a lever unit capable of being protruded into and retracted from the feed path. The lever unit pushes back the second recording medium upstream when protruding into the feed path. The lever unit includes a return operative portion that pushes back the second recording medium upstream and a raising portion that raises the second recording medium above the end support portion.

6 Claims, 19 Drawing Sheets

RETURN LEVER MEMBER, FEED DEVICE, RECORDING APPARATUS, AND LIQUID EJECTING APPARATUS

BACKGROUND

1. Technical Field

The present invention relates to a return lever member, a feed device including the return lever member and a feed roller, a recording apparatus including the feed device, and a liquid ejecting apparatus including the feed device. The feed roller picks up a recording medium from a recording media stacked on a stacking unit and feeds the recording medium downstream via a feed path. The return lever member pushes back upstream another recording medium that has unnecessarily entered the feed path in feeding a necessary recording medium downstream.

A liquid ejecting apparatus used herein is not limited to an ink jet recording apparatus, copier, and facsimile machine, which record information by ejecting ink onto a recording material (e.g., recording paper) from a recording head as a liquid ejecting head. Other examples of the liquid ejecting apparatus include an apparatus that attaches liquid for a specific application, instead of ink, to an ejecting target medium corresponding to the recording material by ejecting the liquid to the ejecting target medium from a liquid ejecting head corresponding to the recording head. Examples of the liquid ejecting head include, in addition to the above-described recording head, a color-material ejecting head used in production of a color filter for a liquid crystal display or other apparatuses, an electrode-material (conductive paste) ejecting head used in formation of an electrode for an organic electroluminescent (EL) display, a surface emitting display (FED), or other apparatuses, a bioorganic-substance ejecting head used in production of a biochip, and a sample ejecting head as a precision pipette.

2. Related Art

A feed device in a known recording apparatus includes a hopper on which sheets of paper are stacked, a feed roller that picks up the uppermost sheet from the sheets of paper, and a return lever member that pushes a sheet of paper that has unnecessarily entered a feed path by its own weight or other reasons back to the hopper, as disclosed in, for example, JP-A-2000-289873. The return lever member can pivot to two positions, one being a protruded position and the other being a retracted position with respect to the feed path. One example of such a known feed device is illustrated in FIGS. 18A and 18B.

As illustrated in FIG. 18A, a feed device 500 includes a hopper 501, a feed roller 502, and a return lever member 503. The return lever member 503 includes lever units 507 which pushes a sheet 506 back by coming into contact therewith and a lever rotating shaft 505*a* being a base and formed integrally with the lever units 507. The lever units 507 are disposed between the feed roller 502 and a pair of transport rollers (not shown) in a feed direction. The lever units 507 are substantially equally spaced from the least significant digit (LSD) side (i.e., the right side in FIGS. 18A and 18B) to the most significant digit (MSD) side (i.e., the left side in FIGS. 18A and 18B) so as to cover the entire range of a feed path 504 for guiding the sheet 506 to the pair of transport rollers (not shown) in a main scanning direction X, which is the direction of width of the sheet 506. In other words, the lever units 507 are aligned over the full range in the main scanning direction so that the lever units 507 can push back the sheet 506 that has unnecessarily entered the feed path 504 even if the sheet 506 has a long size in the main scanning direction X.

However, since the lever units 507 are integral with the lever rotating shaft 505*a*, which has a long size in the common main scanning direction X, the return lever member 503 is an elongate component in the main scanning direction X as a whole. This may cause difficulty in dimensional control. In addition, the long length of the return lever member 503 in the main scanning direction X may significantly increase costs and may create distortion thereof caused by twisting. One approach to addressing these problems is to remove one or more lever units 507 in the MSD side to have a short lever rotating shaft 505*b*, as illustrated in FIG. 18B.

In this case, however, it is difficult to provide the lever units 507 to the full range in the main scanning direction X in the feed path 504. If the sheet 506 is relatively long in the main scanning direction X, the places of the lever units 507 may be biased toward the LSD side with respect to the center in the direction of width of the sheet 506 (X). In this case, unfortunately, frictional resistance generated between the feed path 504 and the sheet 506 when the return lever member 503 pushes back the sheet 506 may cause an MSD-side end of the sheet 506, which is not in contact with the lever units 507, to be located downstream of an LSD-side end of the sheet 506, which is in contact with the lever units 507.

The weight of the sheet 506 may also causes the MSD-side end of the sheet 506, which is not in contact with the lever units 507, to be lower than (downstream of) the LSD-side end of the sheet 506, which is in contact with the lever units 507.

That is, there is the possibility of being unable to reliably push back the sheet 506 unnecessarily entering the feed path 504. The same applies to a case in which the number of the lever units 507 is small.

SUMMARY

An advantage of some aspects of the invention is that it provides a return lever member capable of reliably returning a recording medium that has unnecessarily entered a feed path upstream of the feed path, a feed device including the return lever member, a recording apparatus including the feed device, and a liquid ejecting apparatus including the feed device.

According to a first aspect of the invention, a feed device includes a feed roller and a return lever member. The feed roller picks up a first recording medium from recording media stacked on a stacking unit and feeds the first recording medium downstream via a feed path. The return lever member pushes back upstream a second recording medium that has unnecessarily entered the feed path in feeding the first recording medium downstream. The stacking unit includes an end support portion that supports a leading end of the recording media from below. The return lever member includes a lever unit capable of being protruded into and retracted from the feed path. The lever unit pushes back the second recording medium upstream when protruding into the feed path. The lever unit includes a return operative portion that pushes back the second recording medium upstream, a crook portion which extends above the return operative section, and a stepped section inclined toward the end support portion.

In accordance with the first aspect of the invention, the lever unit includes the return operative portion which pushes back upstream the second recording medium and the raising portion which raises the second recording medium above the end support portion. Therefore, even if there is a recording medium that has unnecessarily entered the feed path, in consideration of a situation in which a first leading end of the recording medium that is not in contact with the lever unit is lower than (downstream of) a second leading end of the recording medium that is in contact with the lever unit, the second leading end of the recording medium can be raised upward by an extra amount taking the above situation into account and thus the leading end of the recording medium can be reliably returned to the end support portion. That is, even when only a part of the full range in the main scanning direction has the lever unit, the leading end of the recording medium can be reliably returned to the end support portion.

For example, there is no need to provide lever units over the full range in the main scanning direction in the feed path. Therefore, when a plurality of lever units formed integral with each other by use of a common shaft are used, the shaft can be shorter than a shaft when the lever units are provided over the full range in the main scanning direction according to the technique in the related art.

Even when only a part of the full range in the main scanning direction has the lever units, a recording medium that has unnecessarily entered can be reliably pushed back to the stacking unit, which is the original place of the recording medium.

For example, this is highly effective for when the lever unit is situated away from the center in the direction of width of the recording medium or when the number of lever units is small.

According to a second aspect of the invention, in the first aspect, the lever unit may be capable of being moved to a first position at which the lever unit is retracted from the feed path for the recording media, a second position at which the raising portion protrudes above the end support portion and raises a leading end of the second recording medium upward, and a third position at which the raising portion does not protrude with respect to the end support portion and the return operative portion blocks the feed path.

According to a third aspect of the invention, in the second aspect, the second position may be upstream of the first and third positions, the third position may be upstream of the first position, and the lever unit may push the second recording medium back to the end support portion by pivoting from the first position to the upstream second position, pivoting from the second position to the downstream third position, and pivoting from the third position to the downstream first position.

In accordance with the second and third aspects, in addition to the same operational advantages as in the first aspect, the lever unit may pivot from the first position to the second position such that the return operative portion is moved upstream in the feed path, pivot from the second position to the third position such that the return operative portion is moved downstream in the feed path, and pivot from the third position to the first position such that the return operative portion is moved downstream. That is, when the lever unit pivots from the first position to the second position, a recording medium that has unnecessarily entered the feed path is first returned upstream, raised, and then pushed, thereby allowing the leading end of the recording medium to be reliably returned to the end support portion of the stacking unit. The lever unit can prevent the recording media stacked on the stacking unit from entering the feed path by pivoting from the second position to the third position and thus blocking the feed path.

That is, the lever unit can prevent a recording medium from entering the feed path in a period from the end of feeding to the start of feeding a next recording medium and also can push a recording medium that has unnecessarily entered the feed path in feeding a recording medium to be fed. The presence of three positions that the lever unit can take allows the lever unit to not merely but reliably push back the recording medium that has entered the feed path.

According to a fourth aspect of the invention, in the first or second aspect, the raising portion may include a stepped section protruding with respect to the return operative portion at a predetermined angle which is less than 180 degrees and bends towards the stacking unit.

In accordance with the fourth aspect, in addition to the same operational advantages as in the first or second aspect, the raising portion may include the stepped section protruding with respect to the return operative portion. Therefore, the leading end of the second recording medium can be reliably raised above the end support portion by being engaged with the stepped section. That is, the leading end of the second recording medium can be reliably raised upward by being engaged with a segment having vertical difference of the stepped section.

According to a fifth aspect of the invention, in the first or second aspect, the raising portion may include an slant section rising with respect to the return operative portion, and the slant section may be substantially parallel to the end support portion while the slant section protrudes above the end support portion.

In accordance with the fifth aspect, in addition to the same operational advantages as in the first or second aspect, the raising portion may include the slant section, and the slant section may be substantially parallel to the end support portion while the slant section protrudes above the end support portion.

Each of the recording media is normally held on the stacking unit so as to have an attitude at which the recording medium is substantially perpendicular to the surface of the end support portion. Therefore, an attitude of the recording medium being pushed back by the lever unit in the feed path may be different from an attitude of the recording medium placed on the stacking unit. In other words, a direction in which the return operative portion moves the recording medium may be different from a direction in which the raising portion moves the recording medium. Even in such a case, since the slant section is substantially parallel to the end support portion, i.e., perpendicular to the attitude of the recording medium placed on the stacking unit, the recording medium having substantially the same attitude as that placed on the stacking unit and being in a state immediately before being fully returned to the stacking unit can be reliably raised above the end support portion.

The expression "the slant section is substantially parallel to the end support portion" used herein indicates that the slant section is substantially parallel to the end support portion such that the slant section can support the recording medium from below.

According to a sixth aspect of the invention, a recording apparatus includes a feed unit and a recording unit. The feed unit picks up a recording medium from stacked recording media and feeds the recording medium to the recording unit. The recording unit records information by ejecting ink to the recording medium. The feed unit includes a feed device according to the first aspect.

In accordance with the sixth aspect, because the recording apparatus includes the feed device according to the first aspect, the same operational advantages as in the first aspect can be obtained in the recording apparatus.

According to a seventh aspect of the invention, a liquid ejecting apparatus includes a feed unit and a liquid ejecting unit. The feed unit includes a feed roller that picks up a first liquid ejecting target medium from liquid ejecting target media stacked on a stacking unit and feeds the first liquid ejecting target medium downstream via a feed path and a return lever member that pushes back upstream a second liquid ejecting target medium that has unnecessarily entered the feed path in feeding the first recording medium downstream. The liquid ejecting unit ejects liquid to the first liquid ejecting target medium. The stacking unit includes an end support portion that supports a leading end of the liquid ejecting target media from below. The return lever member includes a lever unit capable of being protruded into and retracted from the feed path, and the lever unit pushes back the second liquid ejecting target medium upstream when protruding into the feed path. The lever unit includes a return operative portion that pushes back the second liquid ejecting target medium upstream and a raising portion that raises the second liquid ejecting target medium above the end support portion.

In accordance with the seventh aspect, the same operational advantages as in the first aspect can be obtained.

According to an eighth aspect of the invention, a return lever member in a feed device including a feed roller and a return lever member is provided. The feed roller picks up a first recording medium from recording media stacked on a stacking unit that includes an end support portion that supports a leading end of the recording media from below and feeds the first recording medium downstream via a feed path. The return lever member pushes back upstream a second recording medium that has unnecessarily entered the feed path in feeding the first recording medium downstream. The return lever member includes a lever unit capable of being protruded into and retracted from the feed path, the lever unit pushing back the second recording medium upstream when protruding into the feed path. The lever unit includes a return operative portion that pushes back the second recording medium upstream and a raising portion that raises the second recording medium above the end support portion.

In accordance with the eighth aspect, the same operational advantages as in the first aspect can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

A feed device according to an embodiment of the invention and a recording apparatus being one example of a liquid ejecting apparatus that uses the feed device are described below. Firstly, a general structure of an ink jet printer as the best mode for carrying out a liquid ejecting apparatus according to an embodiment of the invention and a recording apparatus being one example thereof is schematically described below with reference to the drawings.

Figure 1:
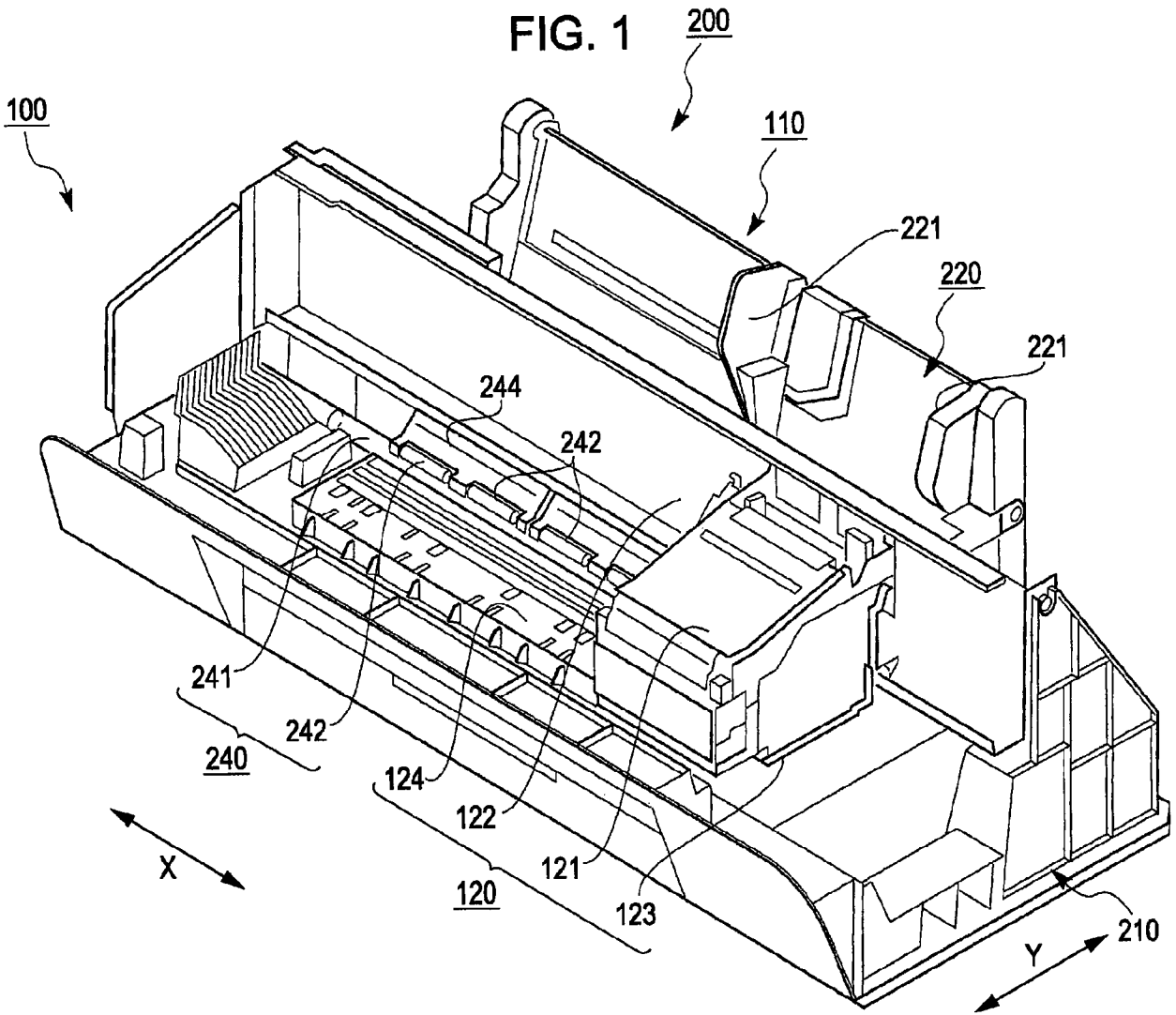
FIG. 1 is a general perspective view illustrating the inside of a recording apparatus according to an embodiment of the invention.
Figure 2:
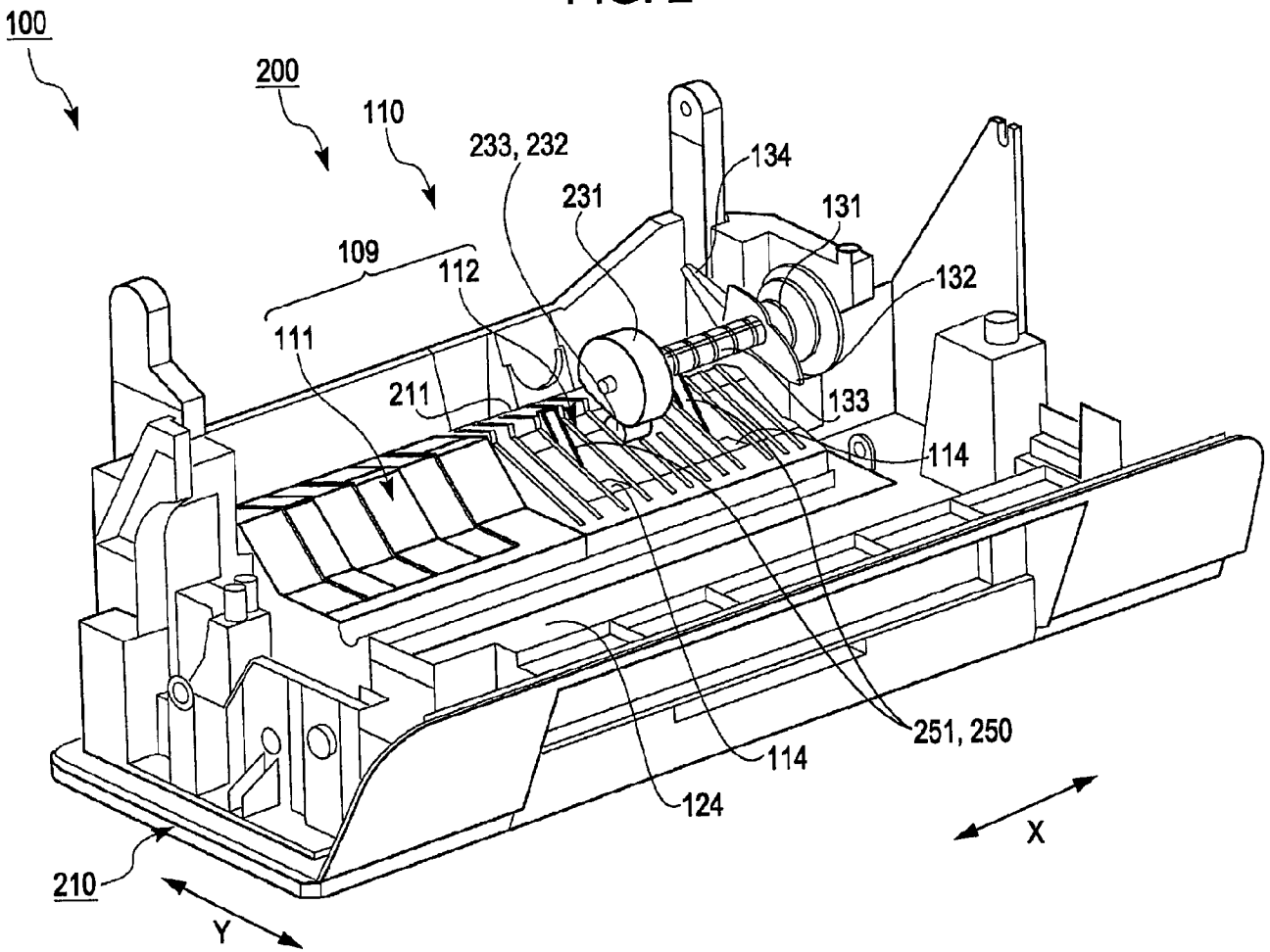
FIG. 2 is a general perspective view of the recording apparatus illustrated in FIG. 1 with a recording unit removed.
Figure 3:
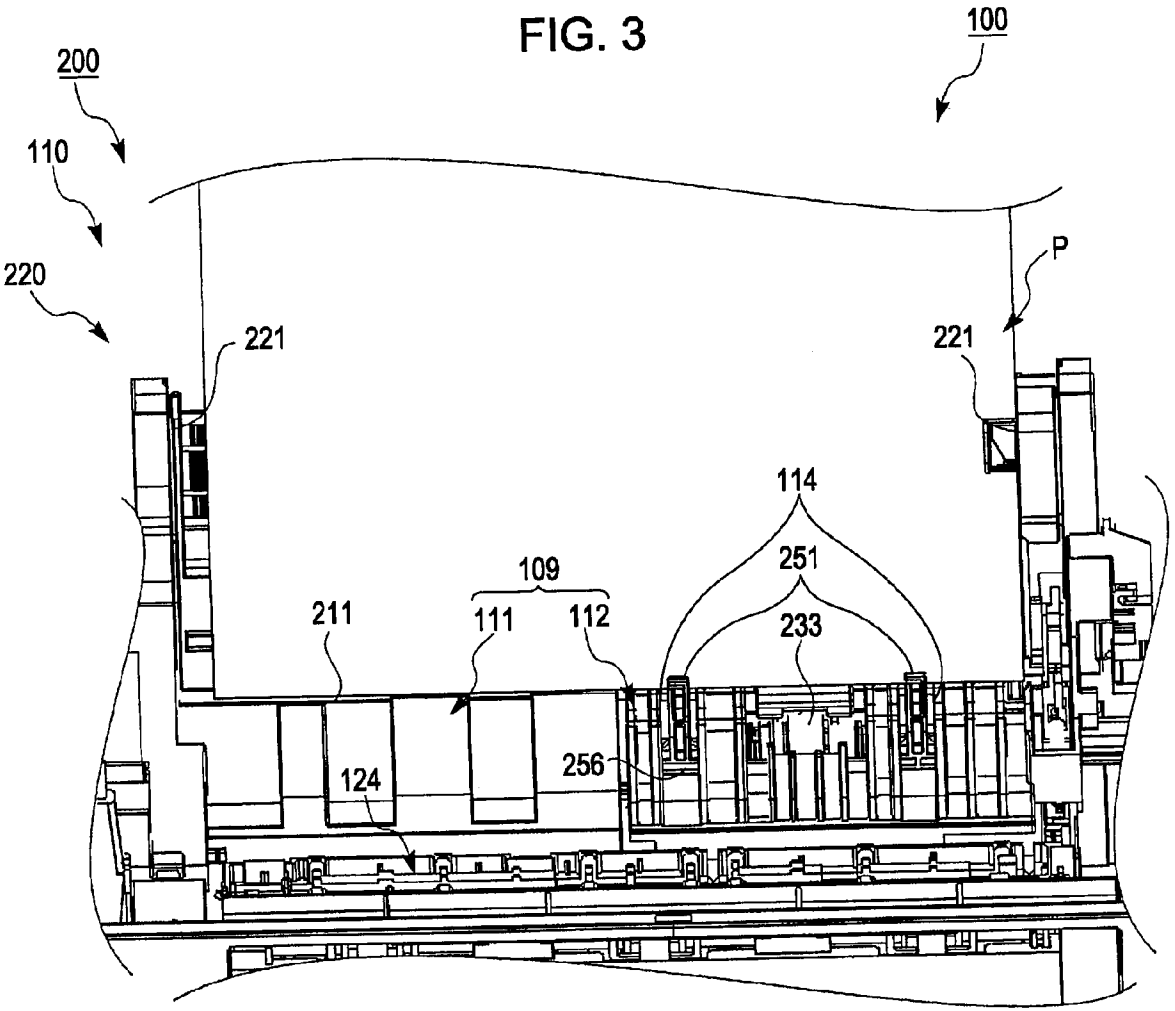
FIG. 3 is a general frontal view that illustrates the inside of the recording apparatus.

FIG. 1 is a general perspective view that illustrates the inside of an ink jet printer according to an embodiment of the invention. FIG. 2 is a general perspective view of the ink jet printer illustrated in FIG. 1 with a recording unit removed. FIG. 3 is a general frontal view of the recording apparatus illustrated in FIG. 2 with a feed roller removed.

As illustrated in FIGS. 1 to 3, an ink jet printer 100 includes a feed unit 110 which feeds a recording medium P being one example of a liquid ejecting target (hereinafter referred to sometimes simply as a sheet P) and a recording unit 120 which records information on the sheet P fed from the feed unit 110. A feed device 200 as the feed unit 110 includes a hopper 220 as a stacking unit on which the sheets P are stacked, a bank portion 211, a feed roller 231 which has a shape of "D" in side view and picks up one of the sheets P from the hopper 220, and a pair of transport rollers 240 which transport the sheet P fed from the feed roller 231.

The hopper 220 can swing on an upper back portion of the ink jet printer 100 such that a lower portion of the hopper 220 can come into contact with and be separated from the feed roller 231. Specifically, the lower portion of the hopper 220 is normally biased against the feed roller 231 by biasing force (not shown). A shaft 133 on which the feed roller 231 is disposed can be rotated by a power device (not shown). A second cam 132 on the shaft 133 is rotated with rotation of the shaft 133, comes into contact with the lower portion of the hopper 220, and thus causes the hopper 220 to swing.

The sheets P are restricted in a main scanning direction X by a pair of side-end restricting units 221 disposed on the hopper 220 in the main scanning direction X. A sub-scanning direction Y is the direction of transport of the sheets P. The sheets P stacked on the hopper 220 are supported from below by the bank portion 211 as an end support portion disposed on a feed base portion 260 being a base of the feed unit 110. It is, of course, to be understood that the feed base portion 260 may be integral with a base unit 210 of the ink jet printer 100.

The timing of swinging of the hopper 220 is described below. While the feed roller 231, which has a shape of "D" in side view, is rotated one rotation counterclockwise in FIG. 2, the lower portion of the hopper 220 is close to the feed roller 231 when a portion of the feed roller 231 that faces the hopper 220 shifts from a chord to an arc of the "D" shape. As a result, the uppermost sheet P of the sheets P stacked on the hopper 220 is picked up by the feed roller 231 and then fed to the pair of transport rollers downstream. When the feed roller 231 is rotated by a predetermined amount, the hopper 220 is moved by the second cam 132 in a direction that is distant from the feed roller 231.

A retard roller 233 being one example of a separation unit 232 is disposed on the base unit 210 so as to face the feed roller 231. The rotation of the retard roller 233 needs a certain load. These components are disposed so as to satisfy the following relationship:

$$\mu 1 > \mu 3$$

$$\mu 2 > \mu 3$$

where $\mu 1$ is the coefficient of friction between the feed roller 231 and the sheet P, $\mu 2$ is the coefficient of friction between the retard roller 233 and the sheet P, and $\mu 3$ is the coefficient of friction between the sheets P. Therefore, even if a plurality of sheets invade a front opening 245 (see FIG. 4) adjacent to the feed roller 231 and the retard roller 233, i.e., so-called an avalanche phenomenon occurs, only one sheet P in contact with the feed roller 231 is fed to the pair of transport rollers 240 by the rotation of the feed roller 231 and the movement of the remaining sheets to the pair of transport rollers 240 is restricted by the retard roller 233.

Subsequently, when the hopper 220 returns to the original place distant from the feed roller 231, a first cam 131 disposed on the shaft 133 comes into contact with a cam follower 134. The cam follower 134 is provided with a return lever member 250 which pushes a sheet back to the bank portion 211 upstream. As will be described below, the return lever member 250 includes a plurality of lever units 251, a lever base 256 being its base, and the cam follower 134. The lever units 251 and the cam follower 134 are integral with each other via the lever base 256.

The return lever member 250 can pivot together with the rotation of the cam follower 134. The return lever member 250 can be protruded into and retracted from a feed path 109 from and to below first guide 112 through lever insertion openings 114 of the feed base portion 260. The lever units 251 can push back to the hopper 220 another sheet almost unnecessarily being fed when a sheet P is being fed by the feed roller 231. Therefore, the sheet restricted by the retard roller 233 is returned to the hopper 220 by the lever units 251 of the return lever member 250.

The sheet P fed to the pair of transport rollers 240 is subjected to a so-called skew removal.

The "skew removal" can use a so-called "nip and release method", in which a leading end of the sheet P is nipped between the pair of transport rollers 240 and then the end is released by reversed rotation of the pair of transport rollers 240 to bend the sheet P, or a so-called "abutment method", in which a leading end of the sheet P abuts against the pair of transport rollers 240 to bend the sheet P.

The pair of transport rollers 240 includes a transport driving roller 241 driven by a power from a power device and a transport driven roller 242 rotated by the transport driving roller 241. The transport driven roller 242 is rotatably hold by a holder 244 and is biased against the transport driving roller 241.

The sheet P is transported to the recording unit 120 by the rotation of the transport driving roller 241. The recording unit 120 records information on the sheet P.

The recording unit 120 includes a recording head 123 which ejects ink onto the sheet P, a platen 124 which supports the sheet P from below and guides the sheet P to a place that faces the recording head 123, a carriage 121 which moves the recording head 123 thereon in the main scanning direction X, and a carriage guide 122 which is attached to the base unit 210 and guides the carriage 121 in the main scanning direction X.

While the sheet P is transported by the rotation of the transport driving roller 241, the carriage 121 scans in the main scanning direction X and the recording head 123 ejects ink, thereby recording information.

In the feed path 109 for the sheet P in the feed device 200, at a side where the sheet P is supported from below in a vertical direction and is guided to the pair of transport rollers 240, the first guide 112 is disposed at the LSD side, which is adjacent to the feed roller 231, and a retraction guide 111 retracted below with respect to the first guide 112 is disposed at the MSD side in the main scanning direction X. The place of the feed roller 231 is biased toward the LSD side with respect to the center of the entire width of the feed path 109. As a result, if the MSD-side portion of the sheet P floats because the pressing force of the feed roller 231 is not substantially applied to the MSD-side of the sheet P, the feed path 109 at the MSD side may be shorter than that at the LSD side. To address this problem, the retraction guide 111 is retracted with respect to the first guide 112 by an amount of shortness so that the feed path 109 at the MSD side is increased. Therefore, the difference between the feed path 109 at the MSD side and that at the LSD side can be reduced, and the possibility of the occurrence of a skew caused by this difference can be suppressed.

The MSD-side portion of the shaft 133 for the feed roller 231 is supported by a bearing (not shown) disposed on the back of the carriage guide 122.

Figure 4:
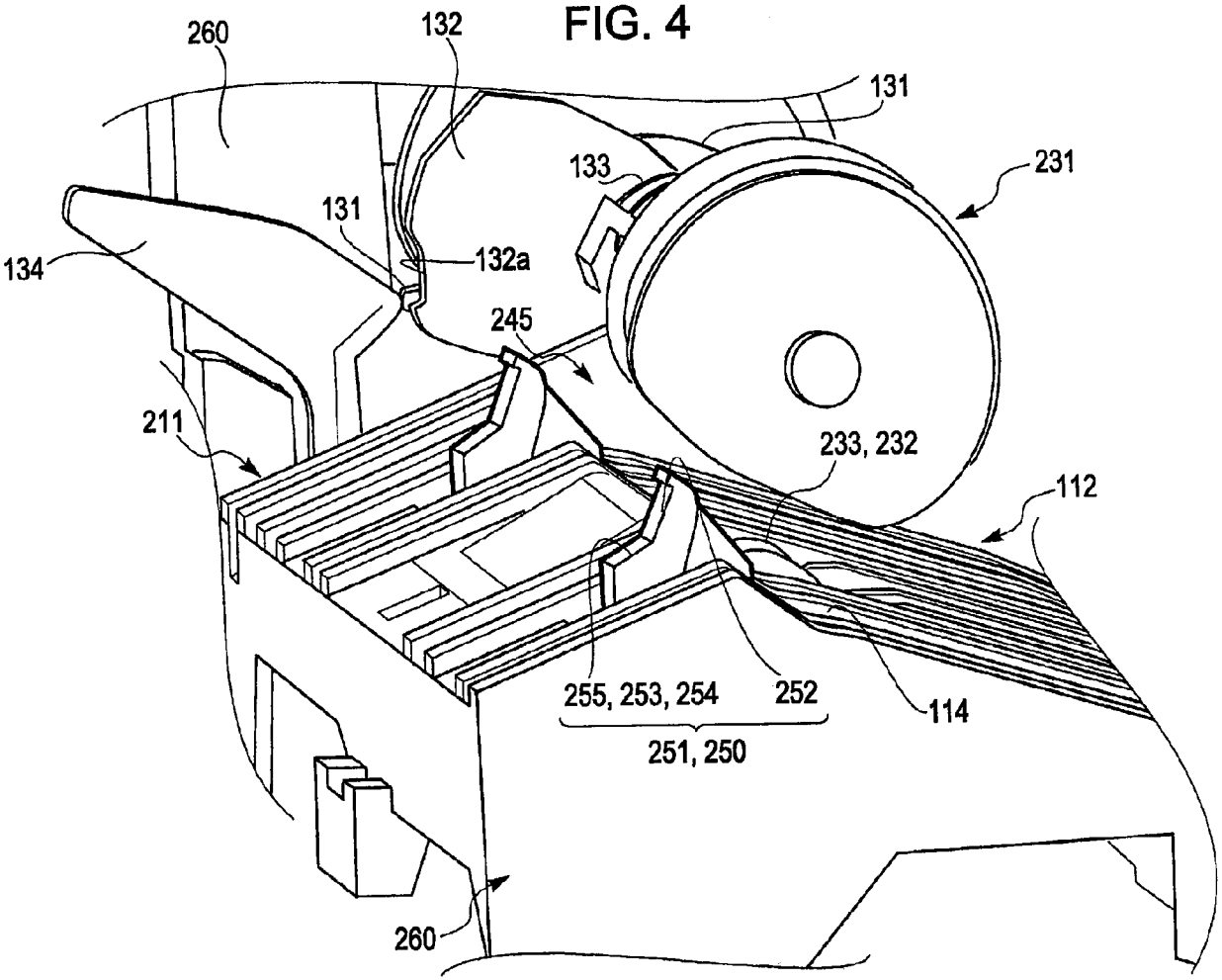
FIG. 4 is an enlarged perspective view that illustrates a main portion of a feed device according to an embodiment of the invention (when lever units push upward).
Figure 5:
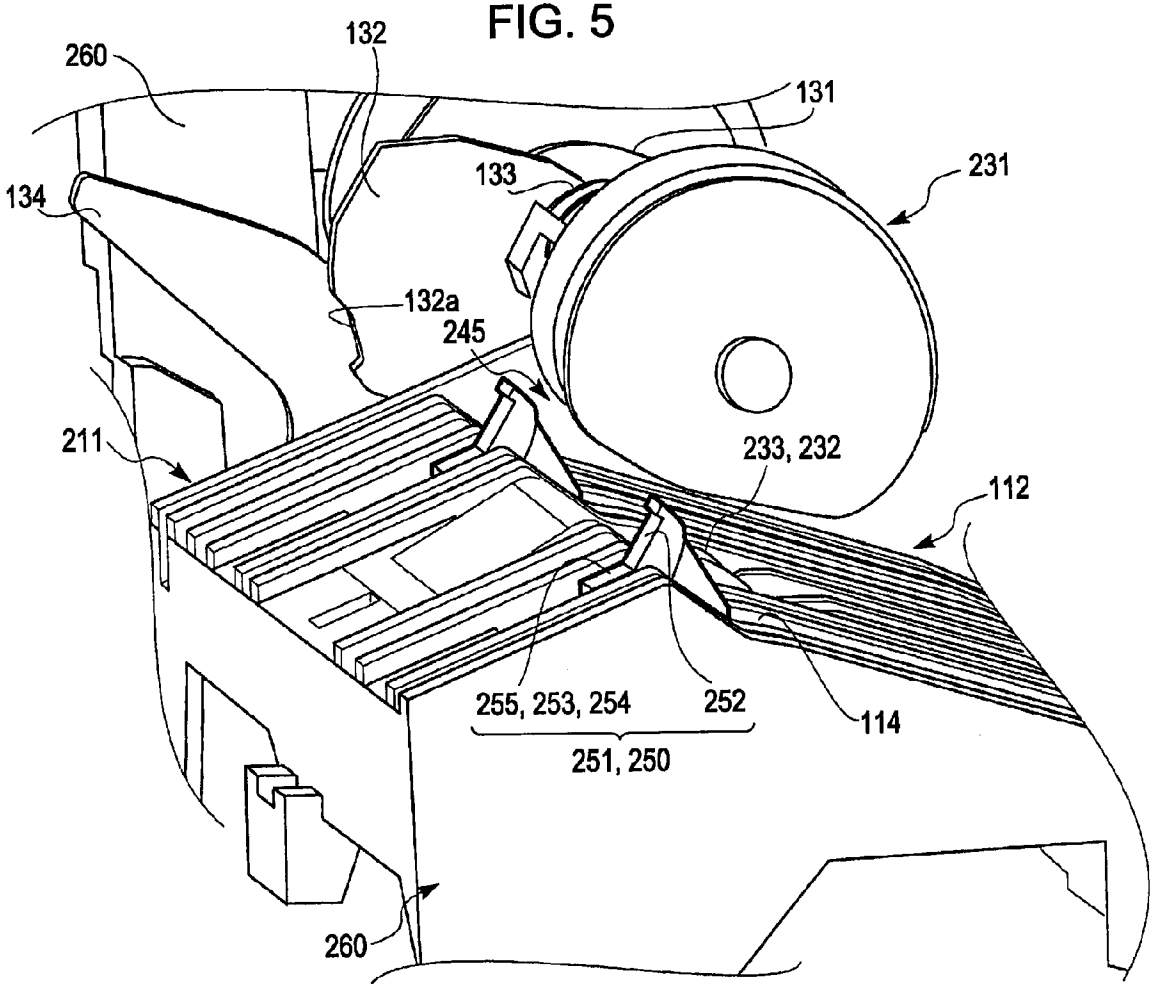
FIG. 5 is an enlarged perspective view that illustrates the main portion of the feed device (when the lever units block a path).

FIGS. 4 and 5 are enlarged perspective view illustrating a main portion of the feed device as the feed unit according to an embodiment of the invention, looked from the MSD side to the LSD side and looked from the upstream side to the downstream sides in the feed direction. FIG. 4 illustrates a state in which the lever units of the return lever member pushes upward (second position), and FIG. 5 illustrates a state in which the lever units block the feed path (third position).

In the specification, a "first position" of the lever units 251 of the return lever member 250 refers to a position at which the lever units 251 are retracted from the feed path 109. The "second position" refers to the most upstream end in a stroke of each of the lever units 251, and at this position, the lever units 251 protrude above the bank portion 211. The "third position" refers to a position between the first and second positions, and at this position, a return operative portion 252 of each of the lever units 251 blocks the feed path 109.

The sheets P refer to general sheets of paper, a sheet P1 is a sheet of paper to be fed, a sheet P2 refers to a sheet of paper that has unnecessarily entered the feed path, and sheets P3 refers to sheets of paper stacked on a hopper.

As illustrated in FIGS. 4 and 5, the feed base portion 260 being the base of the feed unit 110 includes the lever insertion openings 114. The lever units 251 of the return lever member 250 can be protruded into and retracted from the feed path from and to the lower portion of the feed base portion 260 through the lever insertion openings 114. The places of the lever units 251 are biased toward to the LSD side, where the feed roller 231 is disposed, in the main scanning direction X and are adjacent to opposite sides of the feed roller 231.

Although operations will be described below, each of the lever units 251 functions to return the sheet P2 (see FIG. 10), which has unnecessarily entered the front opening 245, by pushing the leading end of the sheet P2 back to the bank portion 211 and to prevent the sheets P3 from invading the front opening 245 from the hopper 220 while the sheet P1 is being fed.

The front opening 245 is defined by the first guide 112 below the feed path 109 and the feed roller 231 above the feed path 109. The feed path 109 between the feed roller 231 and the pair of transport rollers 240 is defined by the first guide 112 disposed therebelow and a second guide (not shown) provided on the lower portion of the holder 244 disposed thereabove.

Each of the lever units 251 includes the return operative portion 252 which pushes back upstream the sheet P2, a crook portion 258 which extends above the return operative portion 252, and a raising portion 253 nearer the pivot than the return operative portion 252. The raising portion 253 includes an stepped section 255 gradually rising with respect to the return operative portion 252 and a descent section 254 which gradually descends back towards a surface of the lever unit which is substantially parallel to the return operative portion 252.

Figure 10:
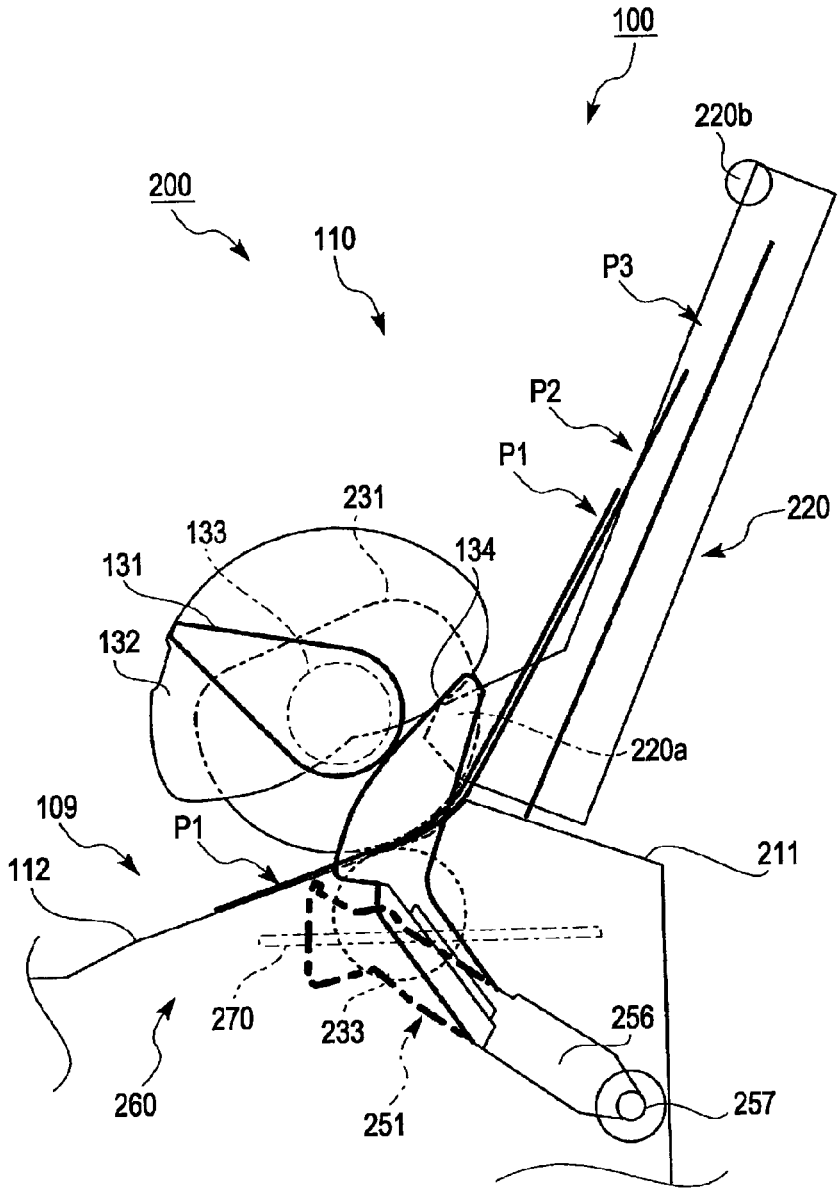
FIG. 10 is a schematic side view that illustrates an operation of the feed device (for the feed roller shaft at an angle of 180°).
Figure 19:
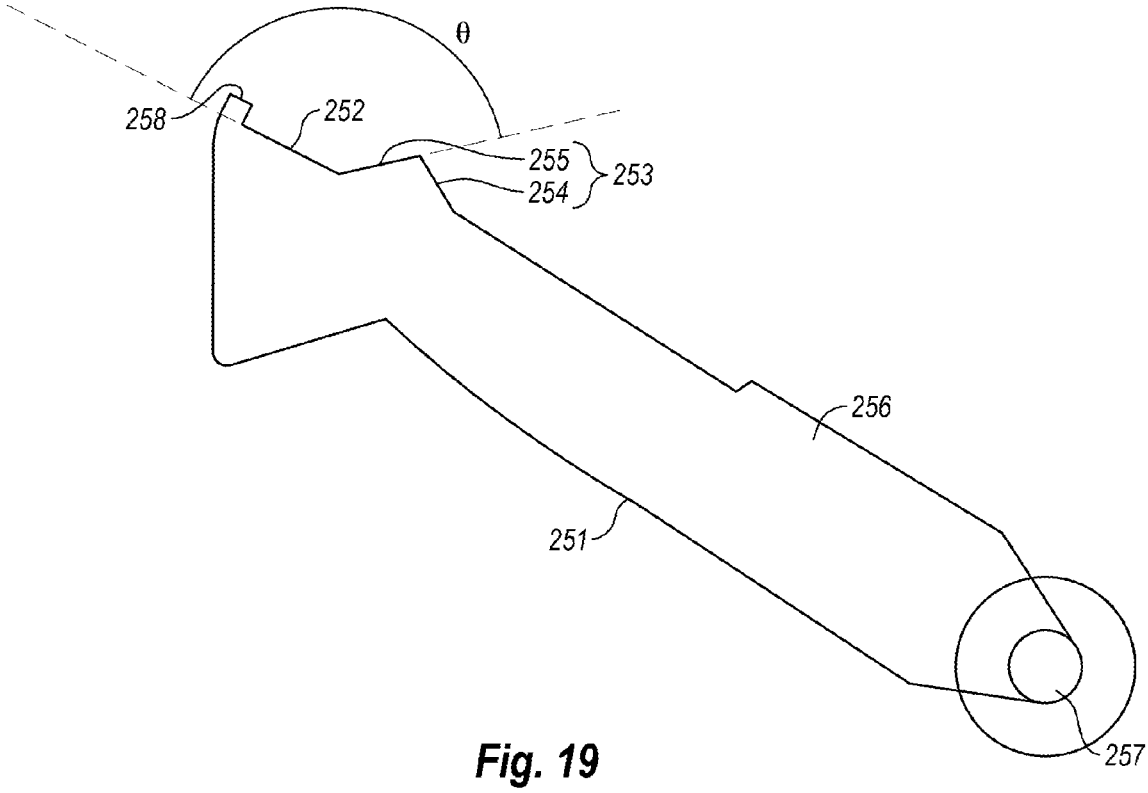
FIG. 19 is a partial schematic side view that illustrates the components of the lever unit.

As shown in FIG. 19, the angle between the return operative portion 252 and the stepped section 255 is a predetermined angle θ, which is less than 180 degrees and bends towards the stacking unit, as shown in FIG. 10. The raising portion 253 may have any shape as long as it can raise the leading end of the sheet P2 above the bank portion 211. Therefore, the shape of the raising portion 253 is not limited to the disclosed embodiments.

As illustrated in FIG. 4, the raising portion 253 can raise the leading end of the sheet P2 pushed back by the return operative portion 252 above the bank portion 211 by protruding above the bank portion 211. At this time, the slant section 255 is "substantially parallel to" the bank portion 211. As a result, the LSD-side leading end of the sheet P2 can be reliably raised above the bank portion 211. The degree of protrusion of the slant section 255 above the bank portion 211 in the "second position" is determined such that the slant section 255 can raise the MSD-side leading end of the sheet P2, which is not to be directly raised by the slant section 255, and return to the bank portion 211 by raising the LSD-side leading end of the sheets P2, which is to be directly raised by the slant section 255.

The degree of descent of a leading end of the sheet P2 that is not directly raised by the lever unit 251 (e.g., the MSD side) by its own weight below a leading end of the sheet P2 that is directly raised by the lever unit 251 (e.g., the LSD side) differs depending on the size and type of the sheet P and the location and size of the lever unit 251. Therefore, the degree of protrusion of the slant section 255 above the bank portion 211 is determined in consideration of these factors.

The expression "the slant section 255 is substantially parallel to the bank portion 211" used herein is such that the slant section 255 is substantially parallel to the bank portion 211 while the slant section 255 protrudes above the bank portion 211 during the pivoting of the slant section 255 together with the pivoting of the lever unit 251.

As illustrated in FIG. 5, in the "third position" of the lever unit 251, the return operative portion 252 blocks the feed path 109. Therefore, this can prevent the leading end of the sheet P (see FIG. 6) from entering the front opening 245 from the bank portion 211. At this time, the slant section 255 is flush with the bank portion 211 or is slightly retracted from the bank portion 211. That is, the slant section 255 does not affect the sheet P at this time. Operations of the lever unit 251 in a cycle of feeding a single sheet P are described below with reference to FIGS. 6 to 17.

Figure 6:
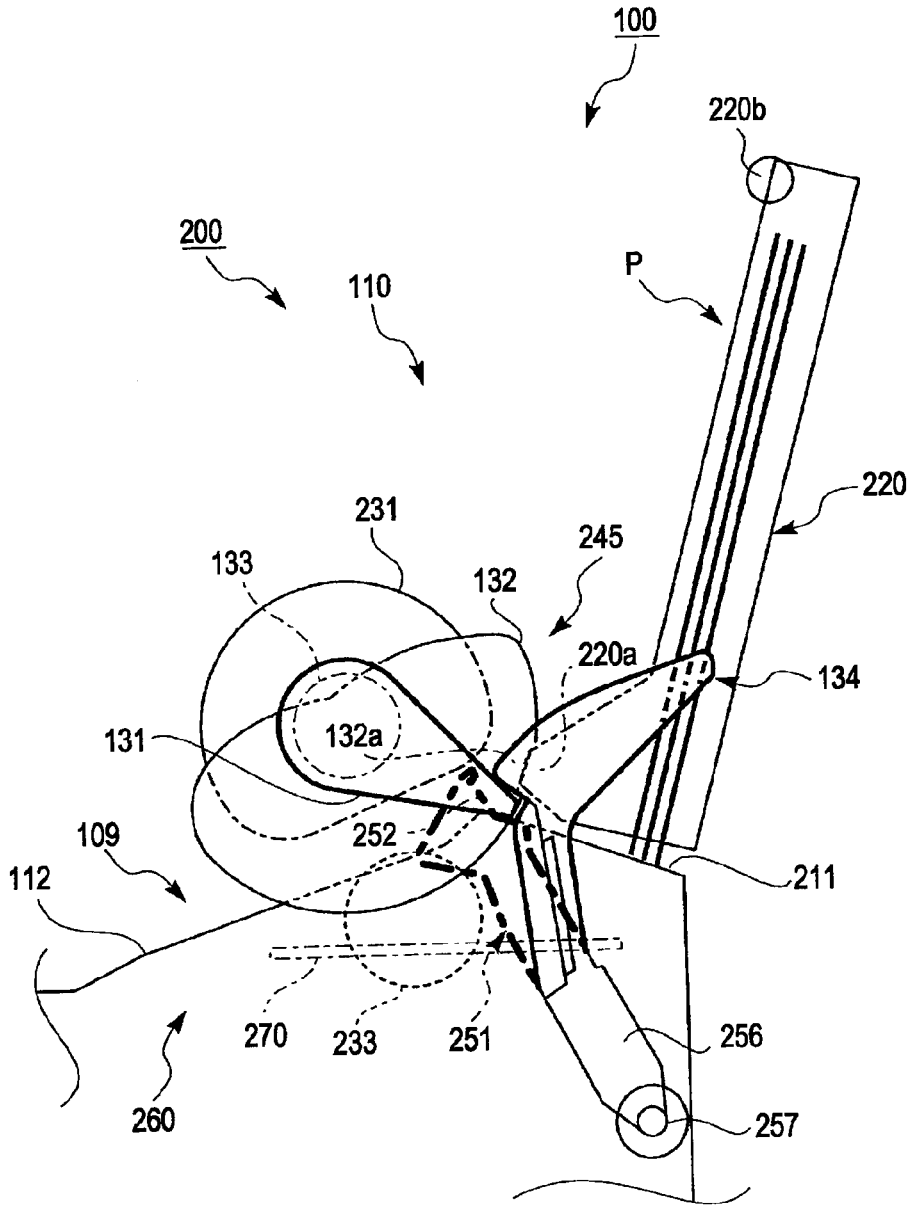
FIG. 6 is a schematic side view that illustrates an operation of the feed device (for a feed roller shaft at an angle of 0°).
Figure 7:
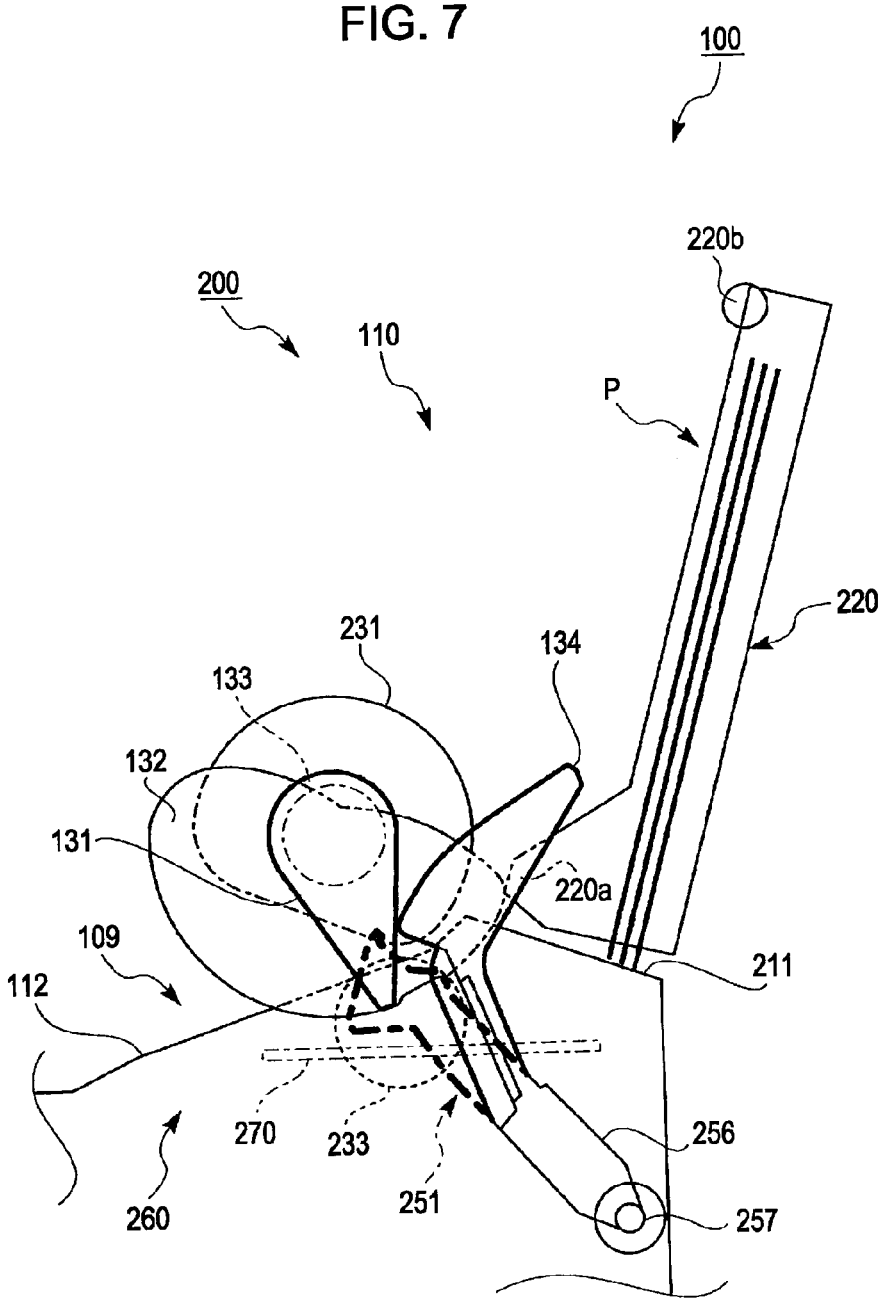
FIG. 7 is a schematic side view that illustrates an operation of the feed device (for the feed roller shaft at an angle of 45°).
Figure 8:
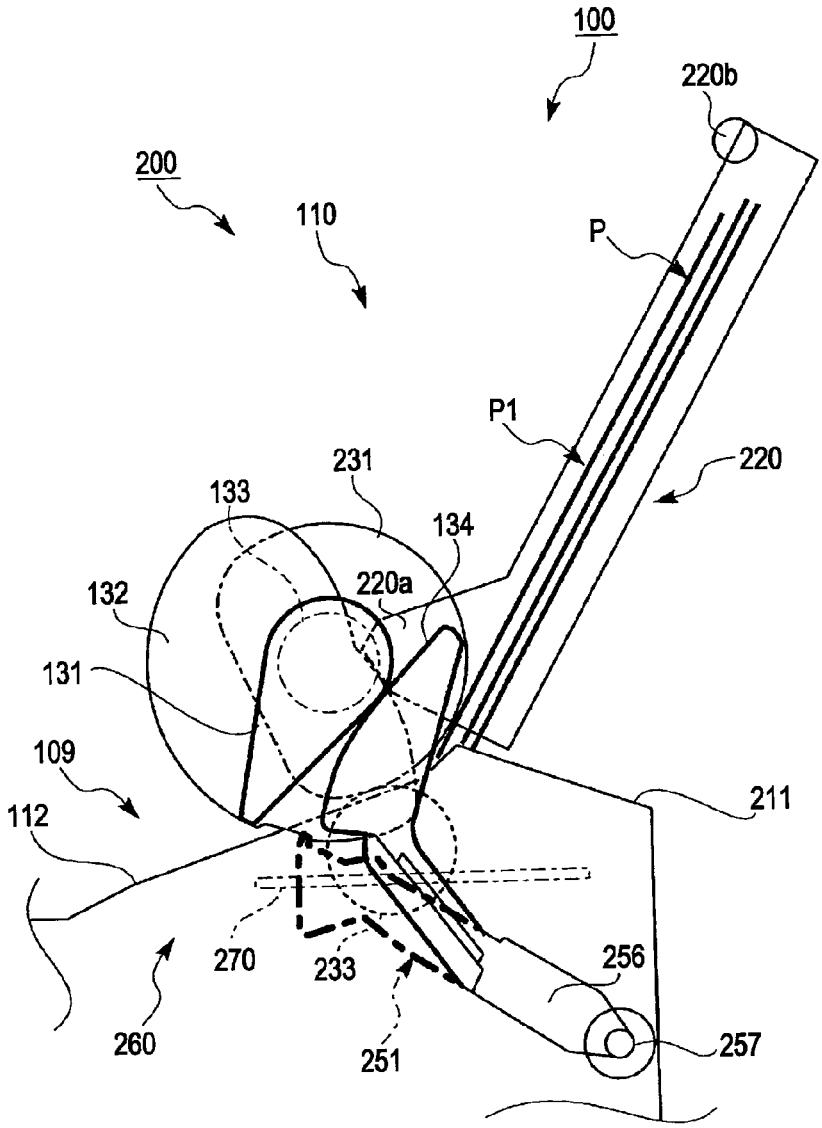
FIG. 8 is a schematic side view that illustrates an operation of the feed device (for the feed roller shaft at an angle of 90°).
Figure 9:
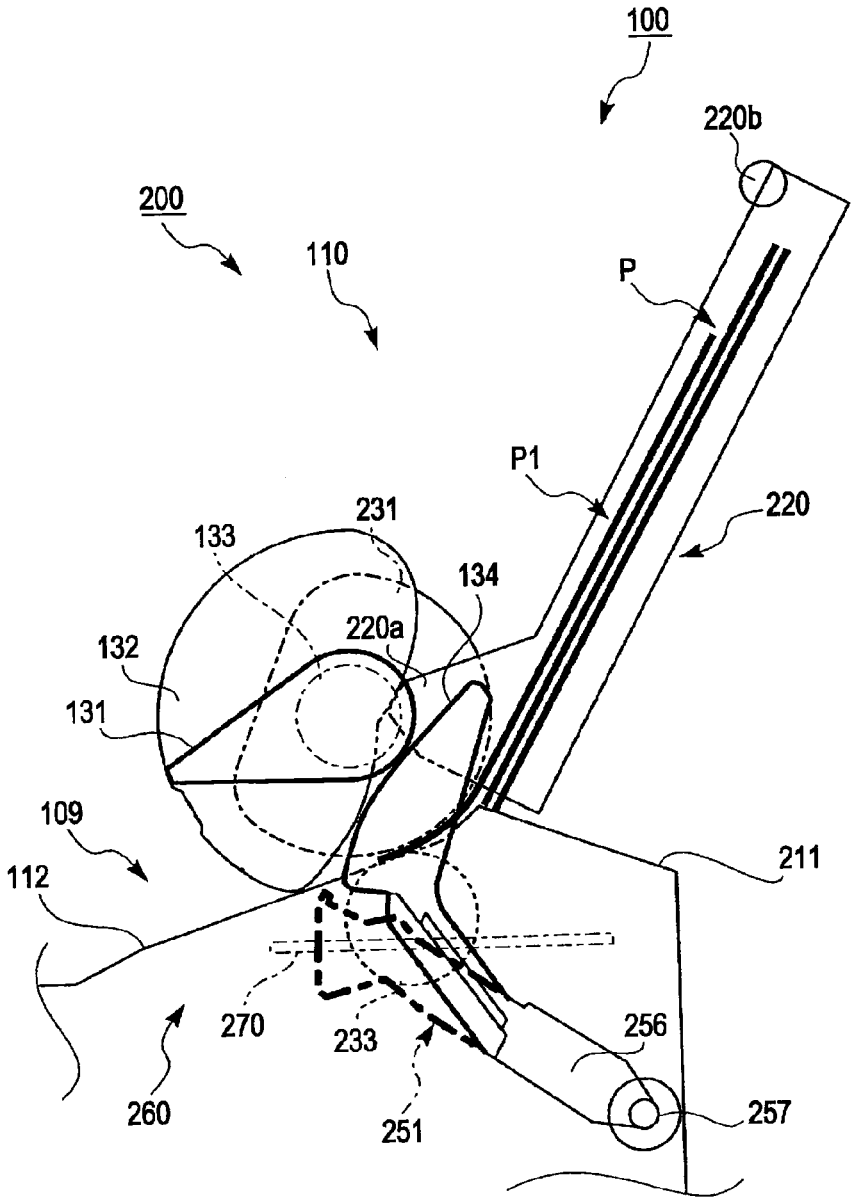
FIG. 9 is a schematic side view that illustrates an operation of the feed device (for the feed roller shaft at an angle of 135°).
Figure 11:
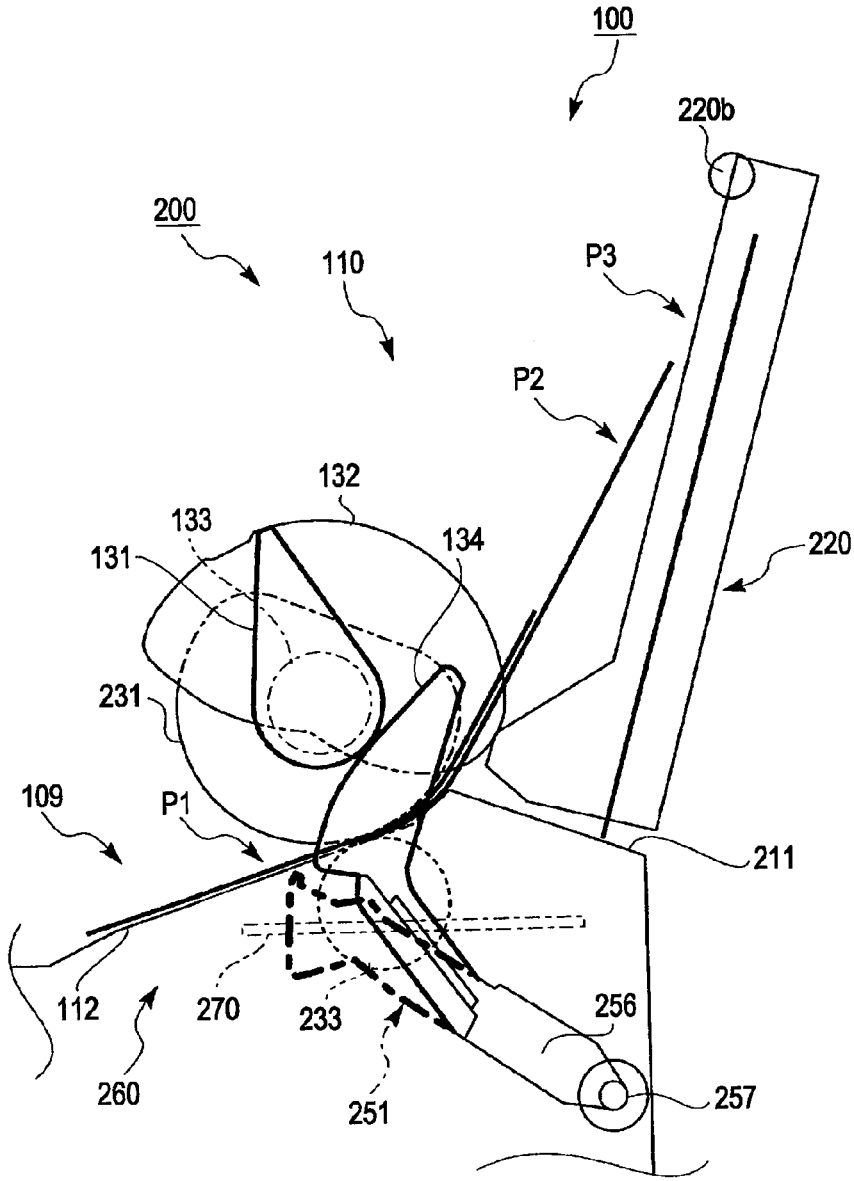
FIG. 11 is a schematic side view that illustrates an operation of the feed device (for the feed roller shaft at an angle of 225°).
Figure 12:
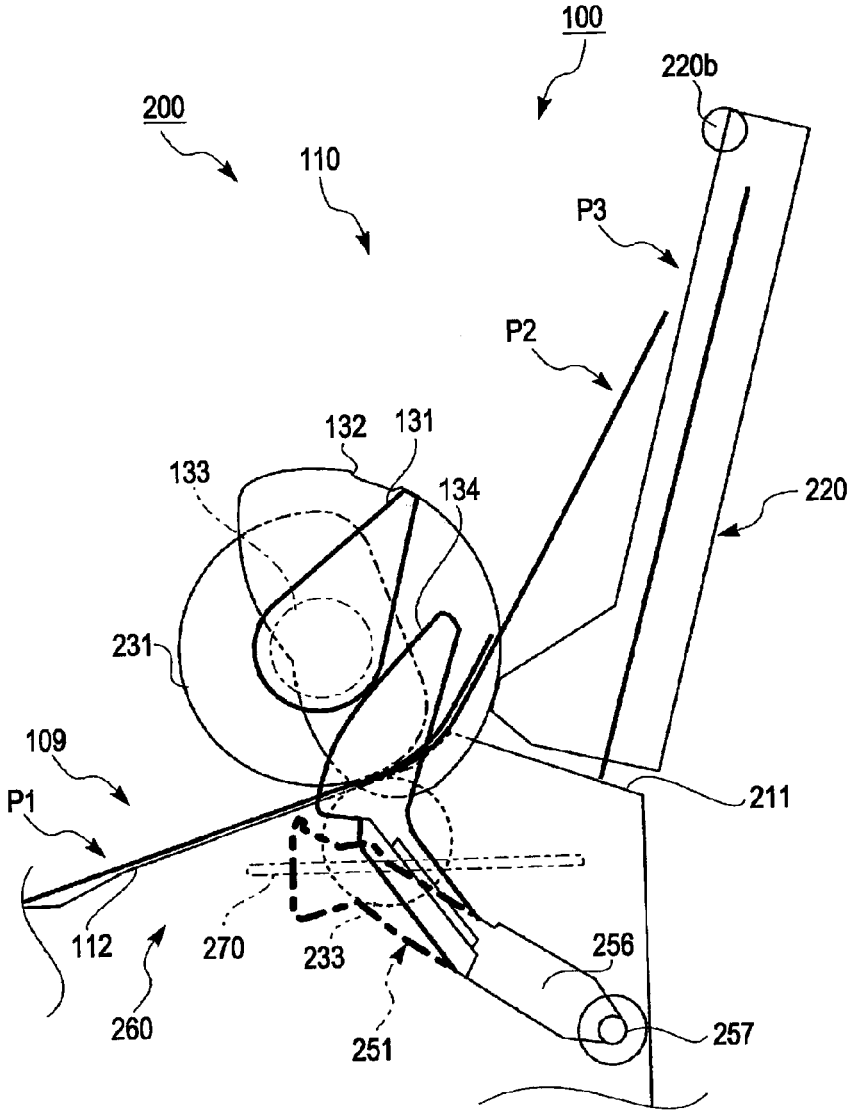
FIG. 12 is a schematic side view that illustrates an operation of the feed device (for the feed roller shaft at an angle of 270°).
Figure 13:
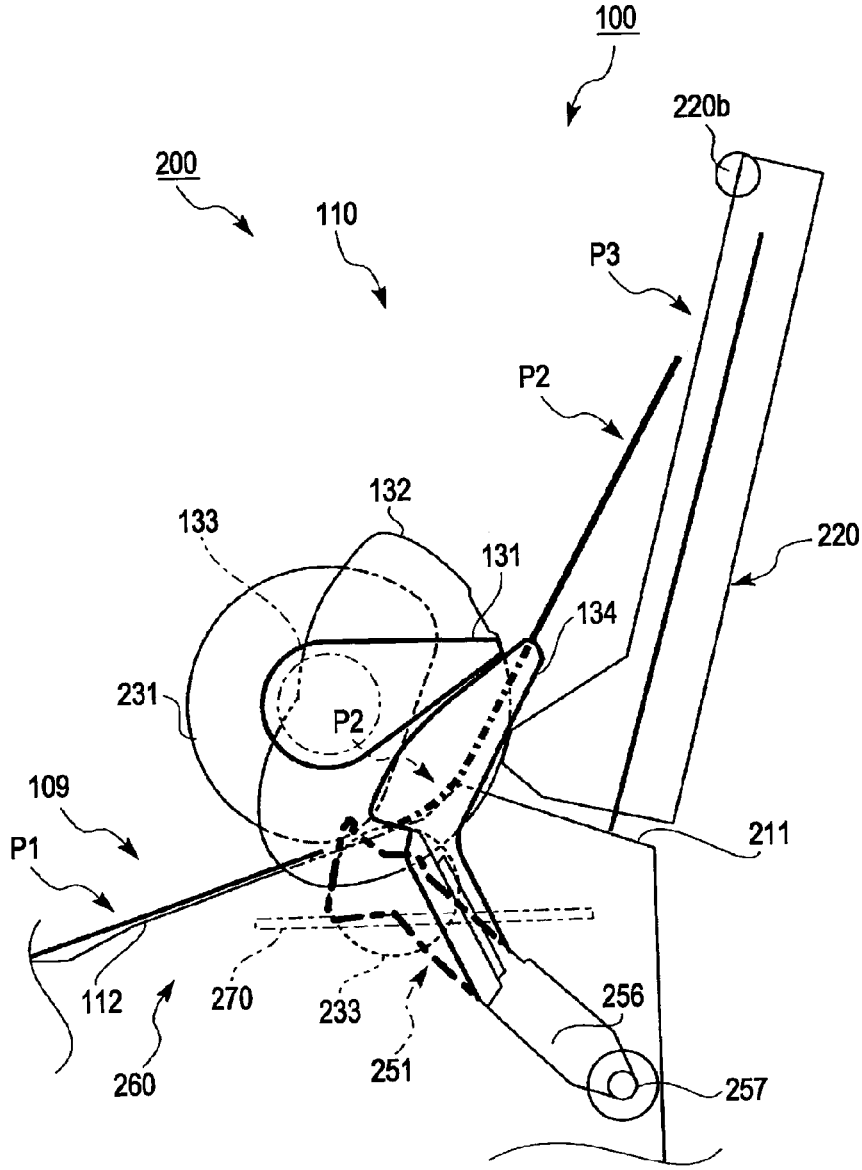
FIG. 13 is a schematic side view that illustrates an operation of the feed device (for the feed roller shaft at an angle of 315°).
Figure 14:
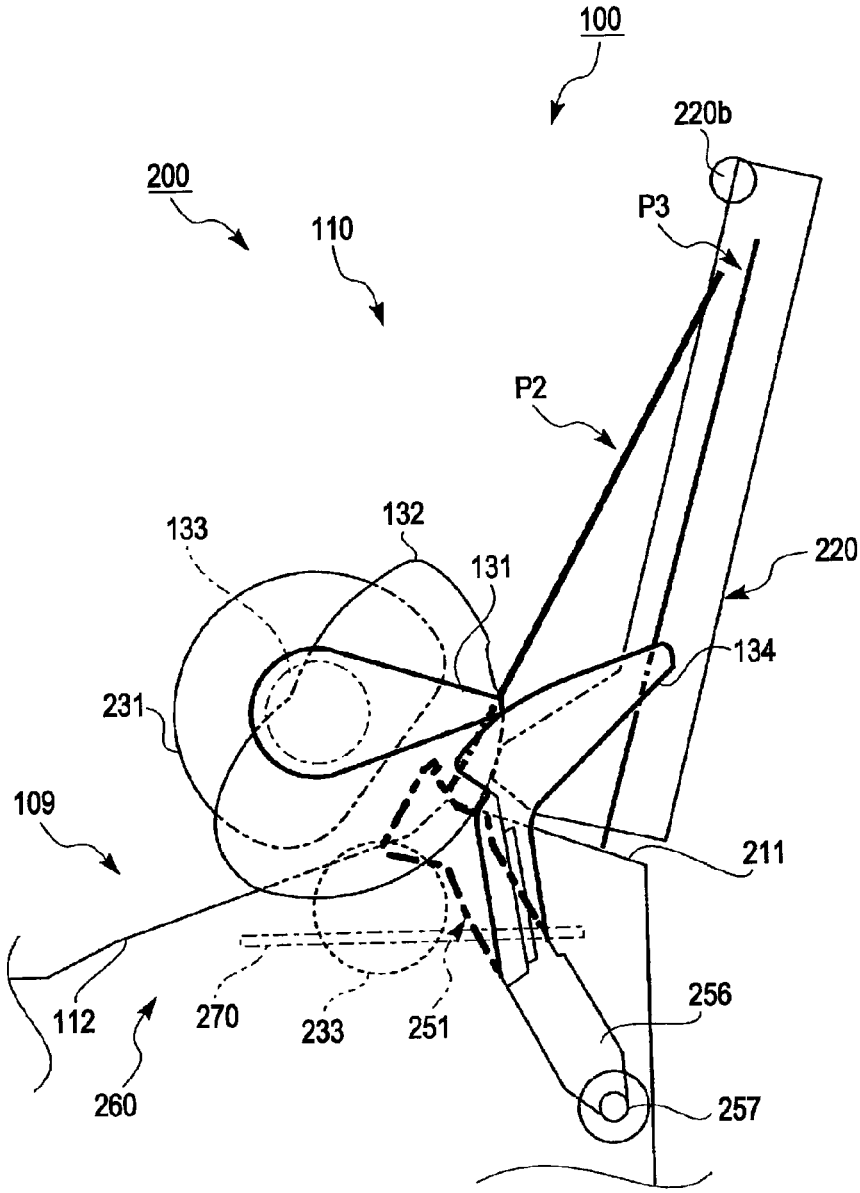
FIG. 14 is a schematic side view that illustrates an operation of the feed device (for the feed roller shaft at an angle of 330°).
Figure 15:
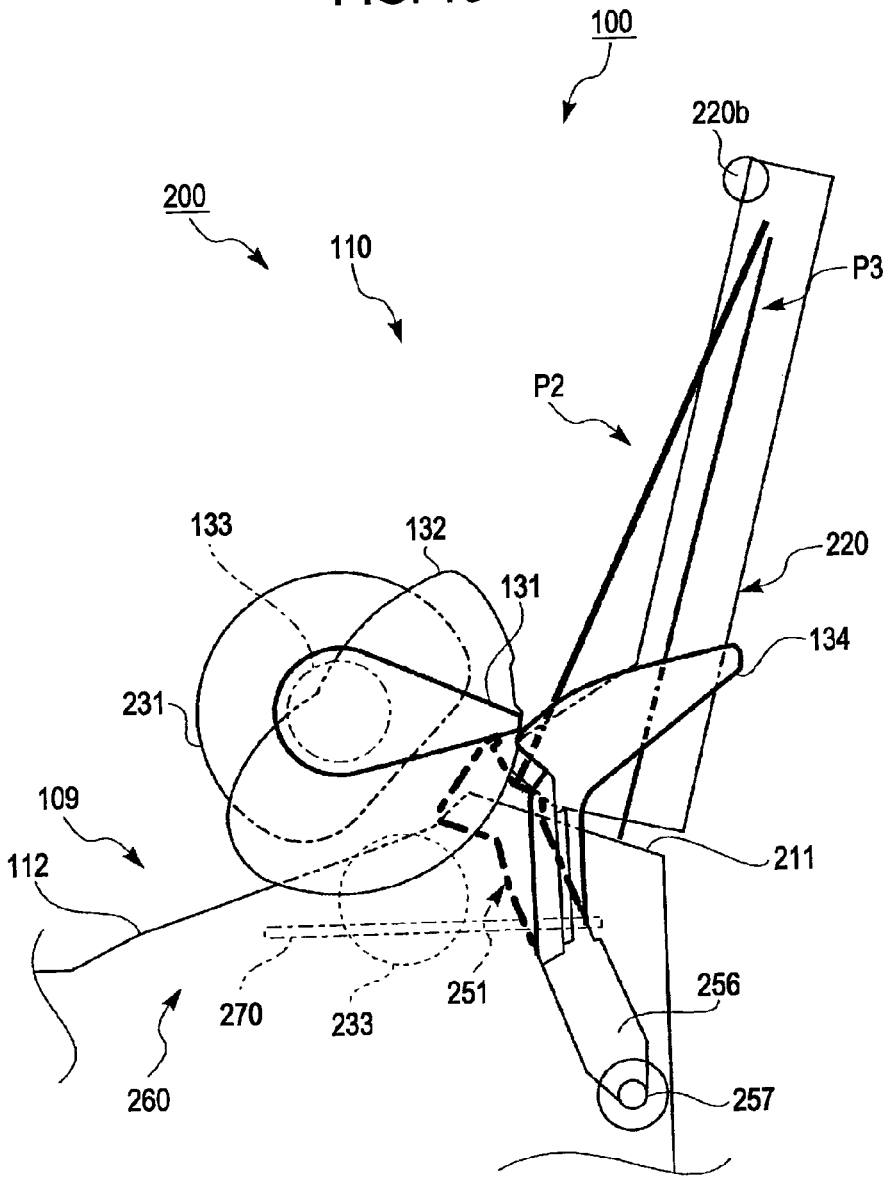
FIG. 15 is a schematic side view that illustrates an operation of the feed device (for the feed roller shaft at an angle of 340°).
Figure 16:
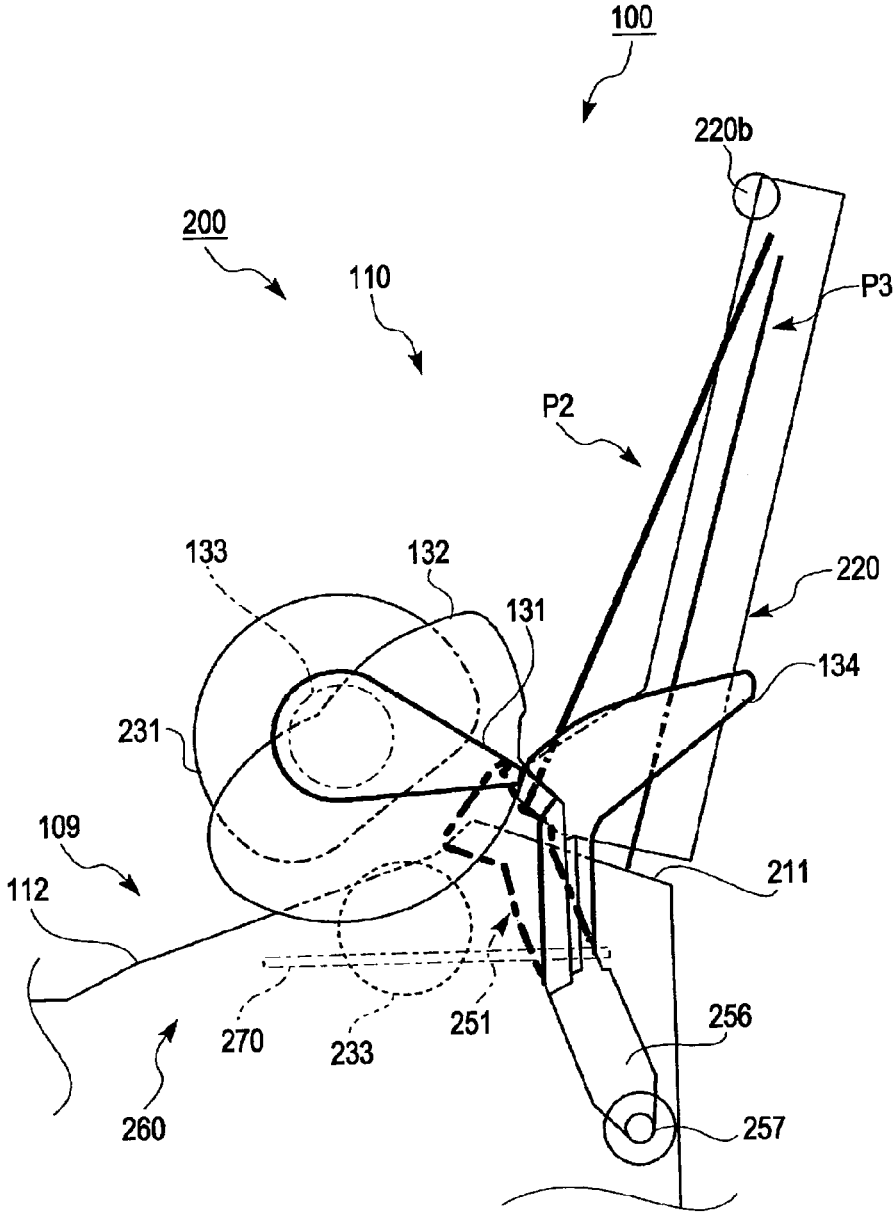
FIG. 16 is a schematic side view that illustrates an operation of the feed device (for the feed roller shaft at an angle of 345°).
Figure 17:
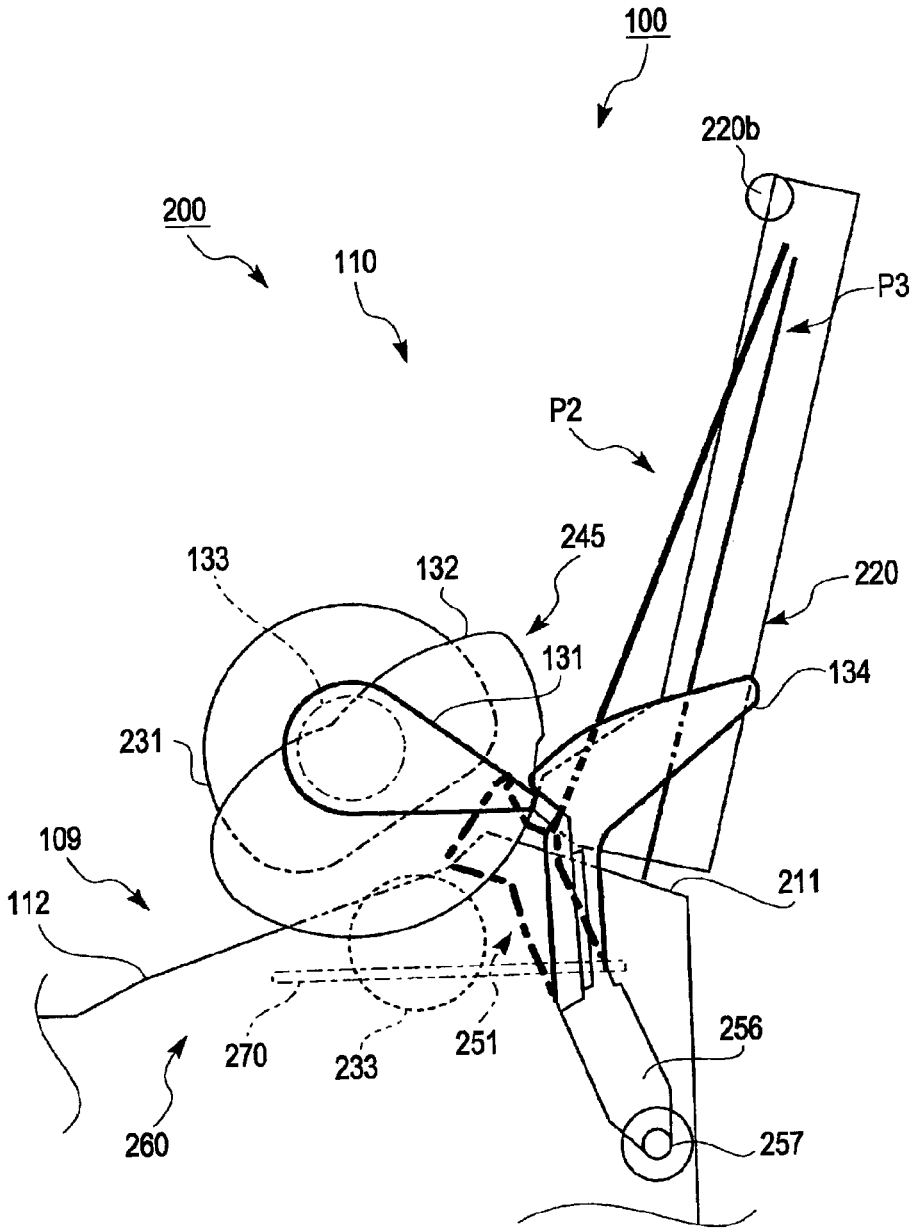
FIG. 17 is a schematic side view that illustrates an operation of the feed device (for the feed roller shaft at an angle of 350°).
Figure 18A:
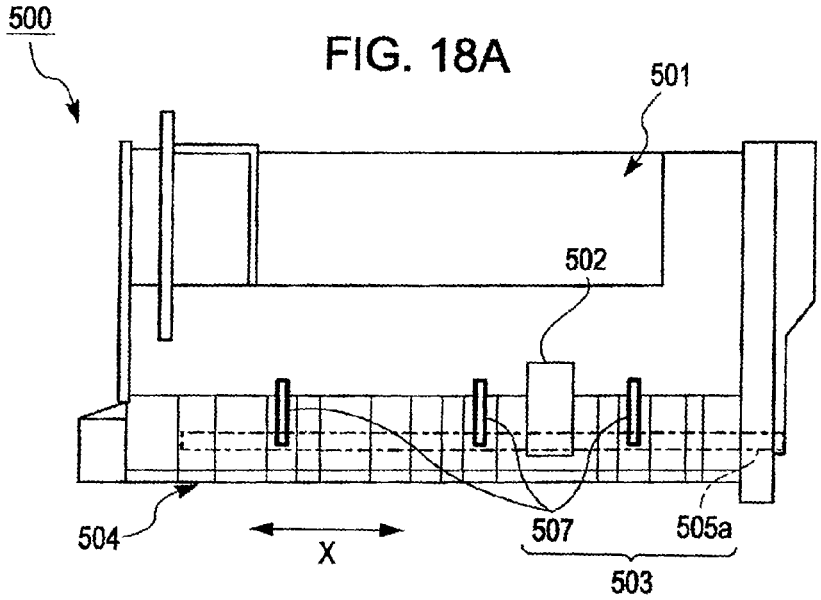
FIGS. 18A and 18B are frontal views that illustrate a known feed device.
Figure 18B:
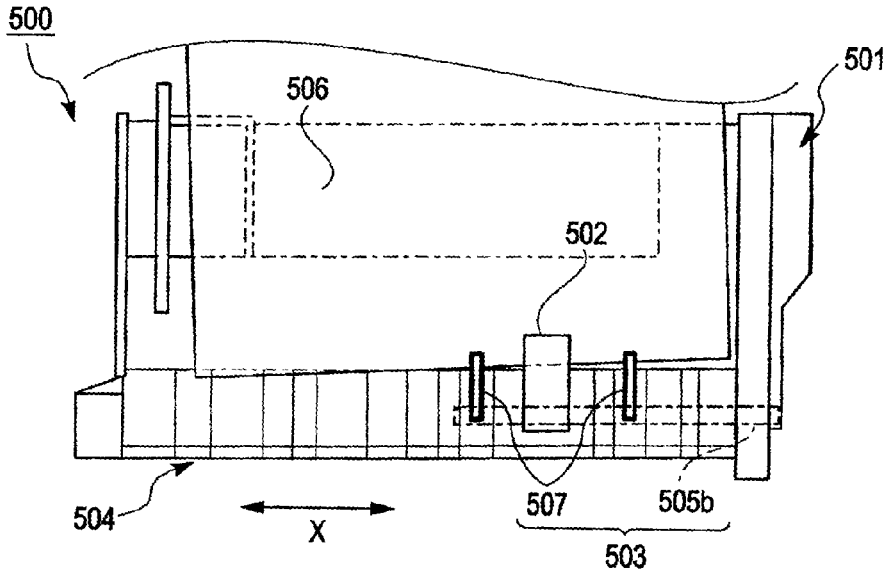

FIGS. 6 to 17 are schematic side views illustrating operations of the feed device according to an embodiment of the invention. FIG. 6 illustrates a state in which the shaft for the feed roller is at an angle of 0°, and this state represents a stand-by position being the "third position". FIG. 7 illustrates a state in which the shaft is at an angle of 45°. FIG. 8 illustrates a state in which the shaft is at an angle of 90°, and this position is the "first position". FIG. 9 illustrates a state in which the shaft is at an angle of 135°. FIG. 10 illustrates a state in which the shaft is at an angle of 180°. FIG. 11 illustrates a state in which the shaft is at an angle of 225°. FIG. 12 illustrates a state in which the shaft is at an angle of 270°. FIG. 13 illustrates a state in which the shaft is at an angle of 315°. FIG. 14 illustrates a state in which the shaft is at an angle of 330°. FIG. 15 illustrates a state in which the shaft is at an angle of 340°. FIG. 16 illustrates a state in which the shaft is at an angle of 345°, and this position is the "second position". FIG. 17 illustrates a state in which the shaft is at an angle of 350°.

As illustrated in FIG. 6, in the stand-by state, the hopper 220 is in a lowered state, i.e., the lower portion of the hopper 220 is not in contact with the feed roller 231. The feed roller 231, which has a shape of "D" in side view, is situated such that the chord of the feed roller 231 faces the first guide 112. The angle of the shaft 133 at this position is represented as 0°.

The hopper 220 is biased by a coil spring (not shown) in a direction at which the hopper 220 pivots clockwise about a hopper pivot 220*b* at the upper portion of the hopper 220. The biasing force brings about the engagement between a projection 220*a* at the lower portion of the hopper 220 and a depression 132*a* of the second cam 132.

The feed base portion 260 is also provided with a cam-follower insertion opening (not shown) for allowing the cam follower 134 to pass therethrough. The both sides of the cam-follower insertion opening in the main scanning direction X are provided with a pair of follower guides 270 which regulates the position and attitude (inclination) of the cam follower 134 in the main scanning direction X throughout a range of rotation of the cam follower 134.

As previously described, in the "third position" of the lever unit 251, the return operative portion 252 of the lever unit 251 blocks the feed path 109. This can prevent the sheets P stacked on the hopper 220 from entering the front opening 245.

As illustrated in FIG. 7, when the shaft 133 is rotated 45° by a power device (not shown) from the state illustrated in FIG. 6, the feed roller 231, the first cam 131, and the second cam 132 are rotated integrally with the shaft 133. At this time, the projection 220*a* of the hopper 220 and the depression 132*a* of the second cam 132 are disengaged from each other. Together with clockwise rotation of the first cam 131, the cam follower 134 receives the biasing force of the above-described coil spring and is rotated about lever fulcrums 257 counterclockwise.

The lever units 251 and the cam follower 134 are formed integrally with each other via the lever base 256. The lever base 256 extends along the main scanning direction X, is formed on the both ends in the main scanning direction X, and can pivot about the lever fulcrums 257 supported by the feed base portion 260.

Therefore, together with counterclockwise rotation of the cam follower 134, the lever units 251 pivot counterclockwise.

The lever fulcrums 257 at the both ends of the lever base 256 are rotatably supported by the feed base portion 260.

As illustrated in FIG. 8, when the shaft 133 is further rotated clockwise from the state illustrated in FIG. 7, the lower portion of the hopper 220 receives the above-described biasing force and is regulated by the second cam 132 and the projection 220*a*, and then the lower portion of the hopper 220 swings so as to approach the feed roller 231. At this time, the sheet P1 being the uppermost sheet of the sheets P stacked on the hopper 220 is picked up by the feed roller 231 and transported to the front opening 245.

Together with the rotation of the shaft 133, the lever units 251 pivot further counterclockwise and are retracted with respect to the first guide 112 in the feed path 109. This retracted position is the "first position" of the lever units 251.

As illustrated in FIG. 9, when the shaft 133 is further rotated clockwise from the state illustrated in FIG. 8, the picked-up sheet P1 is transported to the retard roller 233 within the feed path.

As illustrated in FIG. 10, when the shaft 133 is further rotated clockwise from the state illustrated in FIG. 9, the sheet P1 is transported further downstream. At this time, if the sheet P2, which has been unnecessarily picked up, is present, the sheets P1 and P2 are separated by the retard roller 233, and only the uppermost sheet P1 is permitted to pass through the retard roller 233. That is, the leading end of the separated unnecessary sheet P2 stops at the retard roller 233.

The second cam 132 moves the projection 220*a* disposed at the lower portion of the hopper 220 against the above-described biasing force. Therefore, the hopper 220 pivots counterclockwise about the hopper pivot 220*b* such that the lower portion of the hopper 220 becomes separated from the feed roller 231.

As illustrated in FIG. 11, when the shaft 133 is further rotated clockwise from the state illustrated in FIG. 10, the hopper 220 pivots further about the hopper pivot 220*b* counterclockwise.

As illustrated in FIG. 12, when the shaft 133 is further rotated clockwise from the state illustrated in FIG. 11, the hopper 220 pivots further counterclockwise about the hopper pivot 220*b* and is moved to the lower place, which is the original stand-by position.

During the states illustrated in FIGS. 10 to 12, the clockwise rotation of the feed roller 231 moves the single sheet P1 downstream.

As illustrated in FIG. 13, when the shaft 133 is further rotated clockwise from the state illustrated in FIG. 12, the first cam 131 rotates the cam follower 134 clockwise against the above-described biasing force. Together with the clockwise rotation of the cam follower 134, the lever units 251 pivot clockwise. At this time, the return operative portion 252 of each of the lever units 251 is protruded from the first guide 112 and is moved from upstream of the retard roller 233 to downstream. As a result, as described above, the unnecessary sheet P2 becomes separated by the retard roller 233 and, when the leading end of the sheet P2 has stopped at the retard roller 233, the return operative portion 252 of the lever unit 251 can come into contact with the leading end of the sheet P2 and push it back upstream.

The time at which the return operative portion 252 is protruded from the first guide 112 is a time immediately before the chord of the feed roller 231, which has a shape of "D" in side view, becomes separated from the retard roller 233 and, that is, a time immediately before the sheet P2 stopping at the retard roller 233 becomes released. As a result, there is no possibility of moving the sheet P2 stopping at the retard roller 233 downstream. In addition, the sheet P2 stopping at the retard roller 233 can be pushed back upstream by a reduced force.

As illustrated in FIG. 14, when the shaft 133 is further rotated clockwise from the state illustrated in FIG. 13, the lever unit 251 pivots further clockwise, and the return operative portion 252 is moved upstream in the feed path. The leading end of the sheets P, which has unnecessarily entered the front opening 245, is moved upstream of the front opening 245.

The operation itself of feeding the single sheet P1 to the pair of transport rollers 240 by the feed roller 231 is completed in FIG. 14.

As illustrated in FIG. 15, when the shaft 133 is further rotated clockwise from the state illustrated in FIG. 14, the lever unit 251 pivots further clockwise. The raising portion 253 of the lever unit 251 is then protruded above the bank portion 211. At this time, the leading end of the sheet P2 pushed back by the return operative portion 252 is moved by gravity to the raising portion 253 disposed therebelow in the vertical direction. The leading end of the sheets P2 can be reliably raised above the bank portion 211 by the raising portion 253.

As illustrated in FIG. 16, when the shaft 133 is further rotated clockwise from the state illustrated in FIG. 15, the lever unit 251 pivots further clockwise and is moved to the "second position", where the raising portion 253 is most protruded with respect to the bank portion 211. As previously described, since the degree of protrusion of the raising portion 253 with respect to the bank portion 211 is sufficient, in the main scanning direction X, the leading end of the sheet P2 separated from the lever unit 251 can be reliably drawn from the front opening 245 and moved to the bank portion 211.

For example, this is highly effective for when the number of the lever units 251 is small relative to the length of the feed path 109 in the main scanning direction X or when the number of the lever units 251 is small and the places of the lever units 251 are biased with respect to the center of the feed path 109 in the main scanning direction X. In other words, in the feed device according to the embodiment of the invention, the number of lever units 251 and the length of the return lever member 250 in the main scanning direction X can be reduced. As a result, compared with known arts, dimensional control in manufacture of the return lever member can be facilitated. Since the length of the return lever member in the main scanning direction X is short, costs can also be reduced. In addition, distortion caused by twisting can be reduced.

As illustrated in FIG. 17, when the shaft 133 is further rotated clockwise from the state illustrated in FIG. 16, together with clockwise rotation of the first cam 131, the cam follower 134 receives the above-described biasing force from the coil spring and is rotated about the lever fulcrums 257 counterclockwise. At this time, the raising portion 253 protruding above the bank portion 211 is moved in a retracted direction.

When the shaft 133 is further rotated clockwise, the state shifts to the stand-by state illustrated in FIG. 6. That is, the state shifts to the "third position" of the lever unit 251, in which the raising portion 253 is flush with the bank portion 211 or is slightly retracted from the bank portion 211. Therefore, the raised leading end of the sheet P2 is lowered to the bank portion 211, and the sheet P2 is thus held in the hopper 220, where the sheet P2 should be situated (the same position as the sheets P3). A cycle of a feed operation of the feed unit 110 is completed.

The stroke of the lever unit 251 according to the embodiment of the invention is longer by an amount corresponding to the stroke from the "second position" to the "third position" than that according to the known feed device. The number of positions that the lever unit 251 can take according to the embodiment of the invention is three, whereas the number of positions of the lever unit according to the known feed device is two.

The feed device 200 according to the present embodiment includes the feed roller 231 which picks up the sheet P1 as a recording medium from sheets stacked on the hopper 220 as a stacking unit and the bank portion 211 and which feeds the sheet P1 downstream via the feed path 109 and the return lever member 250 which pushes back upstream the sheet P2, which has unnecessarily entered the feed path 109 in feeding the sheet P1 downstream. The stacking unit includes the bank portion 211 as an end support portion that supports the leading end of the sheets P1 to P3 from below. The return lever member 250 includes the lever base 256 and the lever units 251. The lever base 256 and the lever units 251 are formed integrally with each other. The lever base 256 is a shaft extending in the main scanning direction X, which is the direction of width of the sheet P. The lever units 251 radially extend from the lever base 256 and can be protruded into and retracted from the feed path 109 by pivoting of the lever base 256. When protruding into the feed path 109, the lever unit 251 pushes back the sheet P2 upstream. Each of the lever units 251 includes the return operative portion 252 which pushes back upstream the sheet P2 and the raising portion 253 which raises the sheet P2 above the bank portion 211.

The lever units 251 may be moved to the first position, at which the lever units 251 are retracted from the feed path for the sheet P, the second position, at which the raising portion 253 protrudes above the bank portion 211 and raises the leading end of the sheet P2 upward, and the third position, at which the raising portion 253 does not protrude above the bank portion 211 and the return operative portion 252 blocks the feed path 109. The lever units 251 may pivot from the first position to the second position such that the return operative portion 252 is moved upstream in the feed path 109, pivot from the second position to the third position such that the return operative portion 252 is moved downstream in the feed path 109, and pivot from the third position to the first position such that the return operative portion 252 is moved downstream.

The raising portion 253 according to the present embodiment may include the stepped section 255 protruding with respect to the return operative portion 252 at the predetermined angle θ. The stepped section 255 may substantially parallel to the bank portion 211 while the stepped section 255 is disposed above the bank portion 211.

According to the present embodiment, the place of the feed roller 231 is biased with respect to the center of the feed path 109 in the main scanning direction X. The return lever member 250 includes at least two lever units 251 in the main scanning direction X. The at least two lever units 251 are adjacent to opposite sides of the feed roller 231.

The ink jet printer 100 according to the present embodiment includes the feed unit 100 which picks up the sheet P from the stacked sheets and which feeds the sheet P to the recording unit and the recording unit 120 which records information by ejecting ink to the sheet P. The feed unit 100 includes the feed device 200 described above.

Two lever units described in the embodiment may be replaced with one lever unit or three or more lever units. In the case of one lever unit, it is preferable that the return operative portion and the raising portion be wide in the main scanning direction.

The invention is not limited to the above-described embodiment. It is, of course, to be understood that that various modifications may be made within the scope of the following claims, and the invention encompasses the modifications.

What is claimed is:

1. A feed device comprising:

a feed roller that picks up a first recording medium from recording media stacked on a stacking unit and feeds the first recording medium downstream via a feed path; and a return lever member that pushes back upstream a second recording medium that has prematurely entered the feed path in feeding the first recording medium downstream, wherein the stacking unit includes an end support portion that supports a leading end of the recording media from below, wherein the return lever member can pivot, wherein the return lever member includes a return operative portion that pushes back the second recording medium upstream, a crook portion which extends above the return operative section, and a stepped section inclined toward the end support portion, wherein at a first pivoting position the return lever member projects into the feed path and the return operative portion touches the tip of the recording medium so as to return the recording medium to the upstream side toward the stacking unit, and wherein at a second pivoting position the return lever member projects above the end support portion of the stacking unit while the stepped section lifts the tip of the recording medium above the end support portion while the recording medium is pushed by the return operative portion which is above the end support section, while the stepped section is substantially parallel to the end support portion, and wherein an angle between the return operative portion and the stepped section is less than 180 degrees and bends towards the stacking unit.

2. The feed device according to claim 1, wherein the return lever member is capable of being moved to a first position at which the return lever member is retracted from the feed path for the recording media, a second position at which the stepped section protrudes above the end support portion and raises a leading end of the second recording medium upward, and a third position at which the stepped section does not protrude with respect to the end support portion and the return operative portion blocks the feed path.

3. The feed device according to claim 2, wherein the second position is upstream of the first and third positions, and the third position is upstream of the first position, and the return lever member pushes the second recording medium back to the end support portion by pivoting from the first position to the upstream second position, pivoting from the second position to the downstream third position, and pivoting from the third position to the downstream first position.

4. A recording apparatus comprising:

a feed unit that picks up a recording medium from stacked recording media and feeds the recording medium to a recording unit; and a recording unit that records information by ejecting ink to the recording medium, wherein the feed unit includes a feed device according to claim 1.

5. A liquid ejecting apparatus comprising:

a feed unit including a feed roller that picks up a first liquid ejecting target medium from liquid ejecting target media stacked on a stacking unit and feeds the first liquid ejecting target medium downstream via a feed path and a return lever member that pushes back upstream a second liquid ejecting target medium that has prematurely entered the feed path in feeding the first recording medium downstream; and a liquid ejecting unit that ejects liquid to the first liquid ejecting target medium, wherein the stacking unit includes an end support portion that supports a leading end of the liquid ejecting target media from below, wherein the return lever member can pivot, wherein the return lever member includes a return operative portion that pushes back the second recording medium upstream, a crook portion which extends above the return operative section, and a stepped section inclined toward the end support portion, wherein at a first pivoting position the return lever member projects into the feed path and the return operative portion touches the tip of the recording medium so as to return the recording medium to the upstream side toward the stacking unit, and wherein at a second pivoting position the return lever member projects above the end support portion of the stacking unit while the stepped section lifts the tip of the recording medium above the end support portion while the recording medium is pushed by the return operative portion which is above the end support section, while the stepped section is substantially parallel to the end support portion, and wherein an angle between the return operative portion and the stepped section is less than 180 degrees and bends towards the stacking unit.

6. A return lever member in a feed device including a feed roller and a return lever member, the feed roller picking up a first recording medium from recording media stacked on a stacking unit that includes an end support portion that supports a leading end of the recording media from below and feeding the first recording medium downstream via a feed path, the return lever member pushing back upstream a second recording medium that has prematurely entered the feed path in feeding the first recording medium downstream, the return lever member comprising:

a lever unit capable of pivoting by being protruded into and retracted from the feed path, the lever unit pushing back the second recording medium upstream when protruding into the feed path, wherein the lever unit includes:

a return operative portion that pushes back the second recording medium upstream and stepped section inclined toward the end support portion;

a crook portion which extends above the return operative section; and a stepped section inclined toward the end support portion wherein at a first pivoting position the return lever member projects into the feed path and the return operative portion touches the tip of the recording medium so as to return the recording medium to the upstream side toward the stacking unit, and wherein at a second pivoting position the return lever member projects above the end support portion of the stacking unit while the stepped section lifts the tip of the recording medium above the end support portion while the recording medium is pushed by the return operative portion which is above the end support section, while the stepped section is substantially parallel to the end support portion, and wherein an angle between the return operative portion and the stepped section is less than 180 degrees and bends towards the stacking unit.

* * * * *